US008521050B2

(12) United States Patent
Kuribayashi

(10) Patent No.: US 8,521,050 B2
(45) Date of Patent: Aug. 27, 2013

(54) IMAGE FORMING DEVICE AND FUSER

(75) Inventor: Yoshikazu Kuribayashi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 348 days.

(21) Appl. No.: 13/119,282

(22) PCT Filed: Sep. 11, 2009

(86) PCT No.: PCT/JP2009/065894
§ 371 (c)(1),
(2), (4) Date: Mar. 16, 2011

(87) PCT Pub. No.: WO2010/032684
PCT Pub. Date: Mar. 25, 2010

(65) Prior Publication Data

US 2011/0164893 A1 Jul. 7, 2011

(30) Foreign Application Priority Data

Sep. 18, 2008 (JP) ..... 2008-239540

(51) Int. Cl.
*G03G 15/20* (2006.01)

(52) U.S. Cl.
USPC ..... 399/69

(58) Field of Classification Search
USPC ..... 399/69, 67, 82; 219/216
See application file for complete search history.

(56) References Cited

U.S. PATENT DOCUMENTS

| | | | | |
|---|---|---|---|---|
| 8,032,046 | B2 * | 10/2011 | Otsuka | 399/69 |
| 8,422,902 | B2 * | 4/2013 | Sato | 399/69 |
| 2002/0186982 | A1 | 12/2002 | Tamaoki | |
| 2006/0233565 | A1 | 10/2006 | Tamaoki | |

FOREIGN PATENT DOCUMENTS

| | | | |
|---|---|---|---|
| JP | 60-144775 | A | 7/1985 |
| JP | 5-100591 | A | 4/1993 |
| JP | 5-118926 | A | 5/1993 |

(Continued)

OTHER PUBLICATIONS

Notification of Transmittal of Translation of the International Preliminary Report on Patentability (Forms PCT/IB/338 and PCT/IB/373) and the Written Opinion of the International Searching Authority (Form PCT/ISA/237) issued on Apr. 28, 2011, in the corresponding International Application No. PCT/JP2009/065894.

(Continued)

*Primary Examiner* — Susan Lee
(74) *Attorney, Agent, or Firm* — Buchanan Ingersoll & Rooney PC

(57) ABSTRACT

A first temperature is obtained based on an amount of infrared rays incident upon a lens of an infrared temperature sensor, and a second temperature is obtained based on a temperature of a thermistor. A system controller performs first temperature control when a detected temperature difference between the first temperature and the second temperature is less than a predetermined temperature difference, performs second temperature control when the detected temperature difference is equal to or greater than the predetermined temperature difference, and activates an alarm when an elapsed time during which the second temperature control is continuously executed has become equal to or greater than a time that is the sum of a first predetermined time and a second predetermined time.

7 Claims, 23 Drawing Sheets

(56) References Cited

FOREIGN PATENT DOCUMENTS

| | | | |
|---|---|---|---|
| JP | 5-149790 | A | 6/1993 |
| JP | 11-153923 | A | 6/1999 |
| JP | 2001-34109 | A | 2/2001 |
| JP | 2002-23550 | A | 1/2002 |
| JP | 2005-227558 | A | 8/2005 |
| JP | 2006-145968 | A | 6/2006 |

OTHER PUBLICATIONS

International Search Report (PCT/ISA/210) issued on Nov. 2, 2009, by Japanese Patent Office as the International Searching Authority for International Application No. PCT/JP2009/065894.

Supplementary European Search Report dated Sep. 23, 2011, issued in the corresponding European Patent Application No. 09814529.5. (8 pages).

* cited by examiner

IMAGE FORMING DEVICE AND FUSER

TECHNICAL FIELD

The present invention relates to a fuser including heated a body for fusing toner to recording papers by heat, and to a image forming device, such as copiers, facsimiles and various types of printers, including the fuser.

BACKGROUND ART

FIG. 22 illustrates exemplary principal components of a conventional image forming device 1 in which electrophotography is used. An electrophotographic image forming device includes a photoconductor serving as an image carrier. An example of the photoconductor is a photoconductive drum 10 formed into a drum shape. Upon start of an image forming operation, the photoconductive drum 10 is rotated in a direction indicated by an arrow. Then, a surface of the photoconductive drum 10 is sequentially opposed to a primary charging unit 11, an exposure unit 15, a developing unit 12, a transfer roller (transfer unit) 13 and a cleaner 14. Specifically, first, the primary charging unit 11 electrically charges the surface of the photoconductive drum 10 uniformly. The exposure unit 15 emits an exposure light L that is a laser light. The exposure light L removes electric charges from the surface of the photoconductive drum 10 in accordance with image information. As a result, an electrostatic latent image is formed on the surface of the photoconductive drum 10. This electrostatic latent image is visualized by a developer (including toner) of the developing unit 12, and a toner image is formed on the photoconductive drum 10.

On the other hand, a recording paper P contained in a recording paper feed cassette 17 is conveyed in synchronization with formation of a toner image on the photoconductive drum 10. When the recording paper P passes through between the photoconductive drum 10 and the transfer roller 13, the toner image on the photoconductive drum 10 is transferred onto the recording paper P. Thereafter, the recording paper P having an unfused toner image thereon through transfer is guided by a guide plate 23, and conveyed to the inside of a fuser 20.

The fuser 20 includes: a heating rotator internally having a heater; and a pressurizing rotator provided so as to be rotated while being abutted against the heating rotator. The heating rotator is, for example, a heating roller 21 internally including a roller-like heater. The pressurizing rotator is, for example, a pressurizing roller 22 covered with an elastic body such as rubber. The rollers 21 and 22 are pressed to each other in an opposed manner. A pressed region between the rollers 21 and 22 serves as a fusing nip portion N. When the recording paper P passes through the fusing nip portion N, the recording paper P is heated and pressurized. As a result, the unfused toner image is fused onto the recording paper P, and becomes a permanent image.

The recording paper P on which image formation has been performed is then discharged to the outside of the image forming device. Furthermore, transfer residual toner or the like, remaining on the photoconductive drum 10 after the end of transfer, is removed by the cleaner 14. The image forming device is capable of repeatedly carrying out image formation in this manner.

Detection of temperature of the fusing nip portion N includes a contact type method and a non-contact type method. Conventionally, in the contact type temperature detection, a contact type temperature detector has been brought into contact with the heating roller 21 in order to detect a surface temperature of the heating roller 21. Then, based on the temperature detected by the contact type temperature detector, the temperature of the heating roller 21 has been controlled by a heater. Although not illustrated in this example, a thermistor has been used as the contact type temperature detector. The thermistor is brought into contact with the surface of the heating roller 21. Therefore, due to an abnormality such as a disconnection or a short circuit, and damage to the surface of the heating roller 21, abnormalities have frequently been caused in fused images. When the surface of the heating roller 21 is damaged, it is necessary to replace the rollers 21 and 22 or the entire fuser (cartridge). As a result, an increase in replacement cost will be caused. Moreover, the thermistor is normally attached to a fusing unit. Hence, when the fusing unit is replaced, the thermistor is also concurrently discarded. Accordingly, the replacement is not preferable not only in terms of cost but also in terms of resource saving.

Further, a device in which an induction heating type heater is used and a temperature control operation can be increased in speed is also put to practical use nowadays. However, in a system in which the surface temperature of the heating roller 21 is detected by using the conventional thermistor, there has been a disadvantage that a temperature detection response is slow, thus preventing a proper function as a device. In particular, in an induction heating type fuser in which energy conservation of a heater is taken into consideration, power consumption is required to be low during device standby, and a fuse temperature is required to rise quickly only during use. In other words, a detector having a high responsiveness is demanded.

Therefore, there has been proposed non-contact type temperature detection that is carried out using an infrared temperature sensor such as a thermopile. Examples of techniques in which non-contact type temperature detection is adopted include techniques of Patent Literatures 1, 2 and 3.

CITATION LIST

Patent Literature

Patent Literature 1: Japanese laid-open Patent Application No. 11-153923

Patent Literature 2: Japanese laid-open Patent Application No. 2002-23550

Patent Literature 3: Japanese laid-open Patent Application No. 60-14775

SUMMARY OF INVENTION

Technical Problem

As schematically illustrated in FIG. 23, a fuser according to Patent Literature 1 includes a non-contact type temperature detector 50. The fuser is capable of measuring a surface temperature of a heating roller 21 based on a detection signal of the temperature detector 50. The temperature detector 50 includes: a thermopile 51; a thermistor 52; a lens 53; and a casing 54. The thermopile 51 has a hot junction and a cold junction. Infrared rays from the heating roller 21 reach the hot junction via the lens 53. Then, based on a temperature difference between the hot junction and the cold junction, the surface temperature of the heating roller 21 is determined. No infrared rays reach the cold junction serving as a temperature difference criterion. In this case, the thermistor 52 is used in order to detect a temperature of the cold junction.

However, when the temperature detector 50 is used in an environment where its temperature is changed from a low temperature to a high temperature as in the interior of the fuser, condensation occurs on the lens 53. Upon occurrence of condensation, the absolute quantity of infrared rays passing through the lens 53 is reduced. Therefore, a detection output is decreased with respect to an actual temperature of the heating roller 21. Further, if a temperature control part of the fuser erroneously recognizes a low roller temperature, an abnormality is caused in temperature control. Condensation occurs in the following case, for example. In early-morning hours of a cold season like winter, an indoor temperature is low. Upon application of heat to the heating roller 21 in such a situation, the indoor temperature is sharply increased. As a result, condensation occurs on the lens 53. Furthermore, even if the temperature is not sharply increased, condensation occurs on the lens 53 also when moisture contained in a recording paper P is changed into water vapor due to the heat of the heating roller 21.

As a solution to the problem of condensation, a fuser according to Patent Literature 2 has been proposed. In addition to a non-contact type thermopile, this fuser further includes a contact type thermistor. The thermistor is driven so as to be regularly brought into contact with a heating roller 21. Furthermore, the fuser detects a difference between temperatures detected by the non-contact type thermopile and the contact type thermistor by making a comparison therebetween, and makes a correction to the temperature detected by the thermopile in accordance with the detected temperature difference. In this case, the responsiveness of the contact type thermistor to a temperature change in the heating roller 21 is relatively high. Therefore, even if the output of the thermopile is reduced due to occurrence of contamination or the like on a lens 53, the output of the thermopile is appropriately corrected. However, the fuser according to Patent Literature 2 requires a drive mechanism for detaching the thermistor from the heating roller 21. Accordingly, a device structure is complicated. Further, since the thermistor is moved, "floating" of the thermistor (separation from the heating roller 21) might occur due to a change in the stopped position of the thermistor. The "floating" of the thermistor is a contributing factor to erroneous detection, and a remedy for this is desired.

Furthermore, a fuser according to Patent Literature 3 includes, at a position below a non-contact type thermistor, an air ejection member for blowing air toward a front face of an infrared temperature sensor. Air blown from the air ejection member removes condensation occurred on a surface of a lens 53, toner dust that contaminates this surface, etc. However, depending on an air current produced by the air ejection member, the air from the air ejection member might send air having a high moisture content to the lens 53 and might cause condensation on the lens 53.

Condensation and contamination occurred on the lens 53 both cause erroneous detection of the infrared temperature sensor. However, condensation on the lens 53 is eliminated if heat application to the heating roller 21 is continued. On the other hand, contamination of the lens 53 permanently causes erroneous detection of the infrared temperature sensor. Accordingly, condensation and contamination are preferably recognized separately on the part of the fuser in executing appropriate temperature control.

Therefore, the present invention provides an image forming device and a fuser, which are capable of separately recognizing occurrence of condensation that induces temporary erroneous detection and occurrence of contamination that induces permanent erroneous detection in a structure for detecting a temperature based on an amount of infrared rays incident upon a light receiving body (lens).

Solution to Problem

A first invention provides an image forming device for forming a toner image on a recording paper based on a print job including image information, the image forming device including: a heated body for fusing toner to the recording paper by heat; a heater for heating the heated body; a light receiving body located so as not to be in contact with the heated body; a first temperature detector for detecting, based on an amount of infrared rays incident upon the light receiving body from the heated body, a first temperature equivalent to a surface temperature of the heated body; a heat receiving body located so as not to be in contact with the heated body; a second temperature detector for detecting, based on a temperature of the heat receiving body heated by the heated body, a second temperature equivalent to the surface temperature of the heated body; a temperature controller for selectively executing either first temperature control for controlling an output of the heater so that the first temperature follows a predetermined target temperature, or second temperature control for controlling the output of the heater so that the second temperature follows the target temperature; a timer for measuring an elapsed time during which the second temperature control is continuously executed; and a warning device for proving notification of an abnormality in the first temperature detector, wherein the temperature controller performs the first temperature control when a detected temperature difference between the first temperature and the second temperature is less than a predetermined temperature difference, performs the second temperature control when the detected temperature difference is equal to or greater than the predetermined temperature difference, and activates the warning device when the elapsed time has become equal to or greater than a predetermined time.

In the first invention, the following aspects (a) to (c) are preferably adopted.

(a) The predetermined time is a time that is the sum of a first predetermined time and a second predetermined time when the second temperature control is started in a state in which the predetermined target temperature has never been reached by the first temperature control, and/or when the second temperature control is started after occurrence of a print job, and the predetermined time is a time of only the second predetermined time when the second temperature control is started in a state in which the predetermined target temperature has been reached by the first temperature control and then no print job occurs.

(a1) In the aspect (a), the first predetermined time is a first long predetermined time or a first short predetermined time, the first long predetermined time is used as the first predetermined time when the second temperature control is started in a state in which the predetermined target temperature has never been reached by the first temperature control, and the first short predetermined time is used as the first predetermined time when the second temperature control is started after occurrence of a print job.

(b) The temperature controller stops an operation of the heater when the elapsed time has become equal to or greater than the predetermined time.

(b1) In the aspect (b) in particular, the temperature controller does not stop the operation of the heater during occurrence of a print job.

(c) The light receiving body and the heat receiving body are located within a minimum passage width region of the recording paper.

A second invention provides a fuser including a heated body for fusing toner to a recording paper by heat, the fuser including: a heater for heating the heated body; a light receiving body located so as not to be in contact with the heated body; a first temperature detector for detecting, based on an amount of infrared rays incident upon the light receiving body from the heated body, a first temperature equivalent to a surface temperature of the heated body; a heat receiving body located so as not to be in contact with the heated body; a second temperature detector for detecting, based on a temperature of the heat receiving body heated by the heated body, a second temperature equivalent to the surface temperature of the heated body; a temperature controller for selectively executing either first temperature control for controlling an output of the heater so that the first temperature follows a predetermined target temperature, or second temperature control for controlling the output of the heater so that the second temperature follows the target temperature; a timer for measuring an elapsed time during which the second temperature control is continuously executed; and a warning device for proving notification of an abnormality in the first temperature detector, wherein the temperature controller performs the first temperature control when a detected temperature difference between the first temperature and the second temperature is less than a predetermined temperature difference, performs the second temperature control when the detected temperature difference is equal to or greater than the predetermined temperature difference, and activates the warning device when the elapsed time has become equal to or greater than a predetermined time.

Advantageous Effects of Invention

In the image forming device of the present invention, the temperature controller is capable of determining whether or not a warning to a user is necessary by making a comparison between the length of the elapsed time and that of the predetermined time. In other words, the temperature controller is capable of separately recognizing occurrence of condensation that induces temporary erroneous detection, and occurrence of contamination that induces permanent erroneous detection.

In the aspect (a), in a situation where occurrence of condensation is suspected, the temperature controller sets the predetermined time to be longer than that of a situation where occurrence of contamination is suspected, and therefore, the temperature controller is capable of accurately making a distinction between condensation that is eliminated by continuation of heating, and contamination that is not eliminated by continuation of heating.

In the aspect (a1), in the case of occurrence of condensation at the time of activation, the temperature controller sets the first predetermined time to be longer than that of the case of occurrence of condensation in a print job, and therefore, the temperature controller does not waste time for elimination of condensation.

In the aspect (b), the operation of the heater is stopped in the case of occurrence of contamination, thus making it possible to reliably prevent occurrence of a temperature control abnormality.

In the aspect (b1), the operation of the heater is not stopped during occurrence of a print job, thus preventing a reduction in print efficiency.

In the aspect (c), the first temperature detector and the second temperature detector are capable of always determining a region having the same temperature as a detection target. Accordingly, an accurate difference between the temperature detected by the first temperature detector and the temperature detected by the second temperature detector is obtainable. Furthermore, since the light receiving body and the heat receiving body are located at different positions in a longitudinal direction of the heater, flexibility of layout is ensured.

In the fuser of the present invention, the temperature controller is capable of determining whether or not a warning to a user is necessary by making a comparison between the length of the elapsed time and that of the predetermined time. In other words, the temperature controller is capable of separately recognizing occurrence of condensation that induces temporary erroneous detection, and occurrence of contamination that induces permanent erroneous detection.

DESCRIPTION OF EMBODIMENTS

Figure 1:
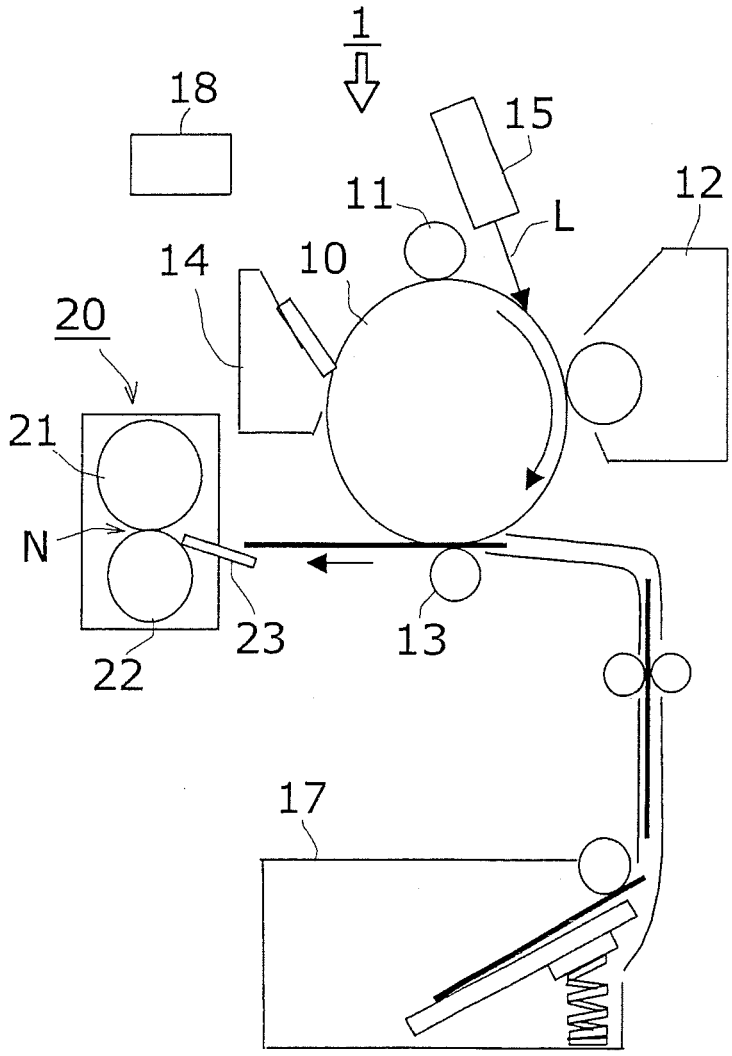
FIG. 1 illustrates exemplary principal components of an image forming device in which electrophotography is used.
Figure 22:
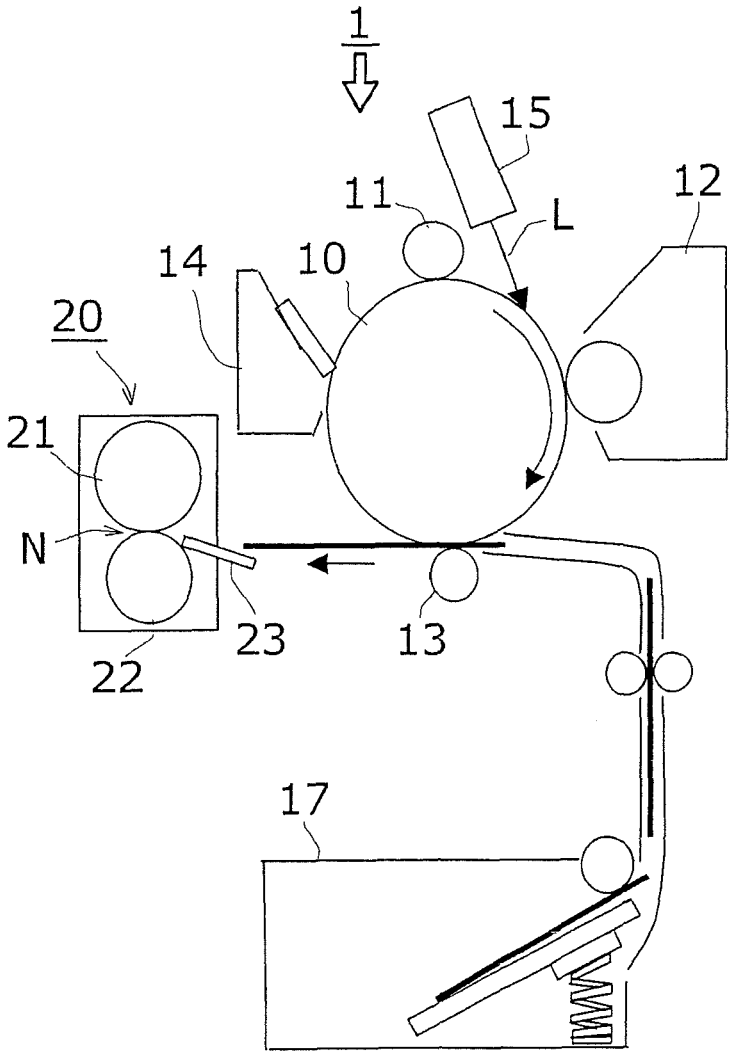
FIG. 22 illustrates exemplary principal components of a conventional image forming device in which electrophotography is used.
Figure 23:
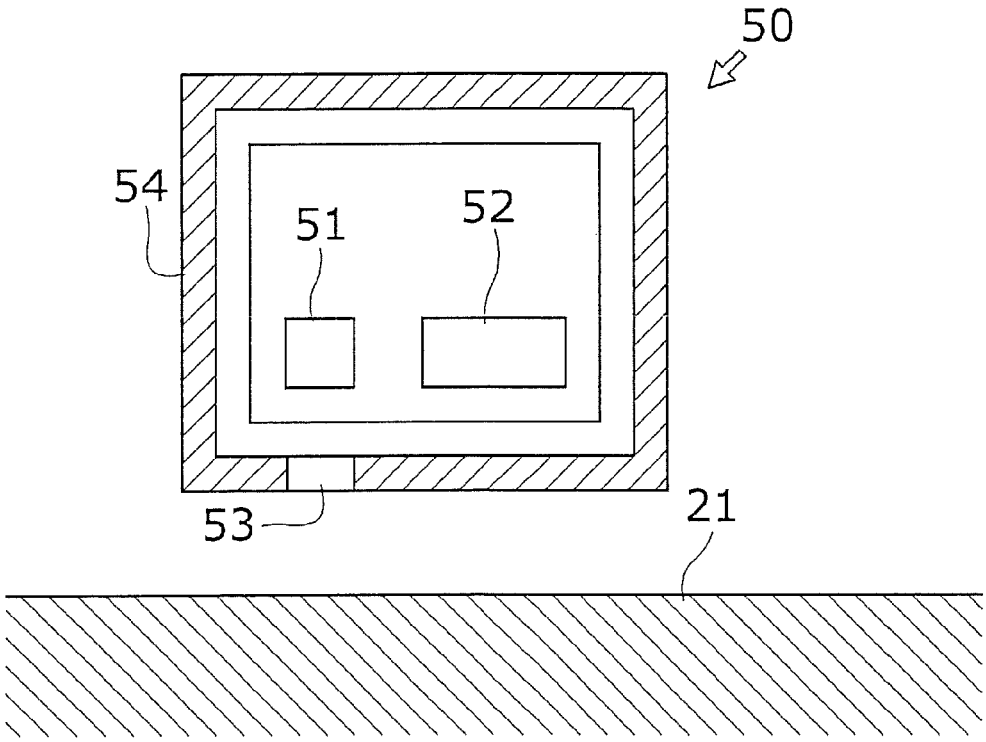
FIG. 23 is a diagram illustrating a structure of a conventional temperature detector.

FIG. 1 illustrates one embodiment of an image forming device of the present invention. Except for a temperature control system of a fuser 20 illustrated in FIG. 1, the present image forming device has a structure similar to that of the image forming device of FIG. 22 described above. It is to be noted that the present image forming device includes a control unit 18 for controlling operations of respective parts of the device, and for acquiring a print job including image information. In this embodiment, a print job occurs by acquiring the print job via an unillustrated communication line by the control unit 18, or by creating the print job based on image data read by an unillustrated scanner.

Figure 2:
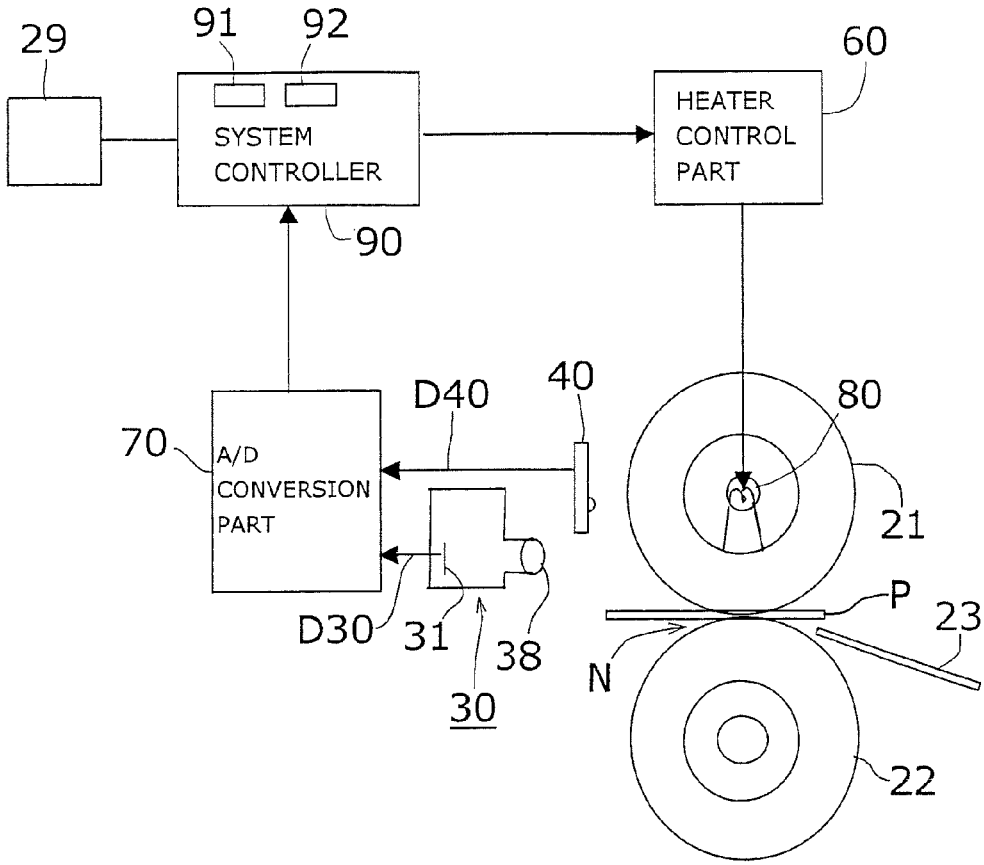
FIG. 2 is a schematic diagram illustrating a fuser.
Figure 3:
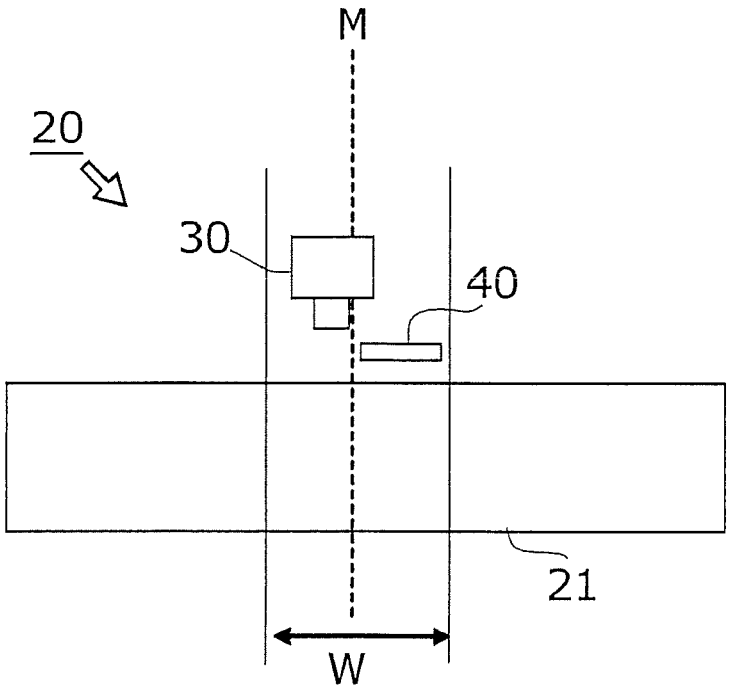
FIG. 3 is a plan view illustrating a positional relationship among a heating roller, a thermopile and a thermistor.

With reference to FIG. 2 and FIG. 3, a structure of the fuser of the present embodiment will be described. FIG. 2 is a schematic diagram illustrating the temperature control system of the fuser 20. FIG. 3 is a plan view illustrating a positional relationship among a heating roller, a thermopile and a thermistor.

Referring to FIG. 2, the fuser 20 includes: a heating roller 21; a pressurizing roller 22; a guide plate 23; the temperature control system; and an alarm 29. The temperature control system includes: an infrared temperature sensor 30; a thermistor 40; an A/D conversion PART 70; a system controller 90; and a heater control part 60. Both of the infrared temperature sensor 30 and the thermistor 40 are non-contact type sensors.

The heating roller 21 has the function of fusing an unfused toner image onto a recording paper P by heat application and fusion. The heating roller 21 includes: a cylindrical body; and a heater 80 located inside the cylindrical body. The cylindrical body is formed of aluminum, for example. The heater 80 is a heat source for applying heat to an outer surface of the heating roller 21. As the heater 80, a halogen lamp and/or a quartz lamp, for example, are/is used. The heating roller 21 is rotated by a rotation drive unit such as an illustrated motor.

The pressurizing roller 22 is pressed to the heating roller 21 and rotated so as to follow the rotation thereof. The pressurizing roller 22 is provided, at both ends of its shaft, with a pressurizing spring (not illustrated) via an unillustrated bearing member. This pressurizing spring urges the pressurizing roller 22 in a direction in which the roller is pressed to the heating roller 21. A fusing nip portion N in the diagram is a pressed region between the heating roller 21 and the pressurizing roller 22. The recording paper P is conveyed by the heating roller 21 and the pressurizing roller 22, and is passed through the fusing nip portion N. The pressurizing roller 22 includes: a cored bar shaft; and a heat-resistant elastic member layer located on an outer periphery of the cored bar shaft. The heat-resistant elastic member layer is formed of silicone rubber or the like, for example.

The guide plate 23 is provided upstream of the fusing nip portion N in a direction in which the recording paper P is conveyed. The guide plate 23 guides the conveyance of the recording paper P toward the fusing nip portion N.

The infrared temperature sensor 30 and the thermistor 40 output electric signals responsive to a surface temperature of the heating roller 21. An output signal D30 from the infrared temperature sensor 30 and an output signal D40 from the thermistor 40 are transmitted to the system controller 90 via the A/D conversion PART 70. The output signals D30 and D40 are subjected to A/D conversion in the A/D conversion PART 70. The system controller 90 detects the surface temperature of the heating roller 21 based on the A/D converted output signal D30 or D40. It should be noted that the system controller 90 detects the surface temperature of the heating roller 21 based on either the output signal D30 or the output signal D40.

The system controller 90 changes electric power supplied from the heater control part 60 to the heater 80, thereby controlling an output of the heater 80. Further, the system controller 90 includes a first timer 91 and a second timer 92.

The alarm 29 sounds an alarm upon reception of a command from the system controller 90. It should be noted that the warning device is not limited to the alarm 29 for sounding an alarm. The warning device may be a device for displaying warning information on a display device provided at a main body of the image forming device 1.

Referring to FIG. 3, the locations of the infrared temperature sensor 30 and the thermistor 40 will be described. Upon passage of the recording paper P through the fuser 20, heat is lost from the heating roller 21 at its region where the heating roller 21 has been brought into contact with the recording paper P. As a result, temperature distribution in a longitudinal direction of the heating roller 21 becomes non-uniform. Hence, a sensor is located at a position at which the temperature of the heating roller 21 is uniform even after the passage of the recording papers P having a plurality of different sizes through the fuser 20.

In the present example, the infrared temperature sensor 30 and the thermistor 40 are located within a region having a minimum passage width W of the recording paper P to be used. The recording paper P to be used refers to the whole of the recording papers P having different sizes, which are used in the image forming device of the present example. The region having the minimum passage width of the recording paper P refers to a region through which the recording paper P conveyed to the fuser 20 passes, and is a zonal region extending along the conveyance direction of the recording paper P. In particular, the minimum passage width region refers to a region having the passage width W provided when the width of the recording paper P to be conveyed is minimized. It should be noted that irrespective of the sizes of the recording papers P, the recording papers P are aligned so that the center of the recording papers P is located on a center line M of the fuser 20.

The infrared temperature sensor 30 and the thermistor 40 are arranged so as not to be in contact with the heating roller 21.

Structure of Infrared Temperature Sensor

Figure 4:
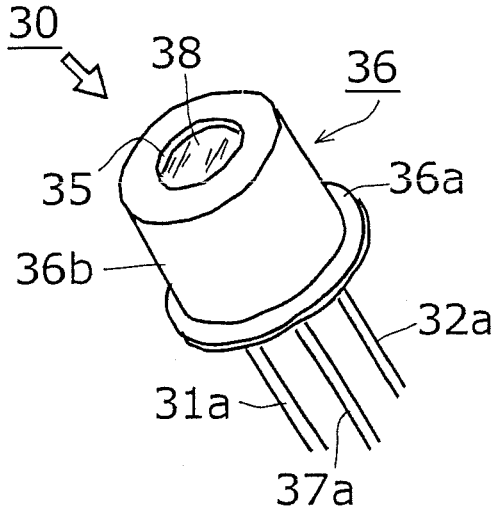
FIG. 4 is an external view of an infrared temperature sensor.
Figure 5:
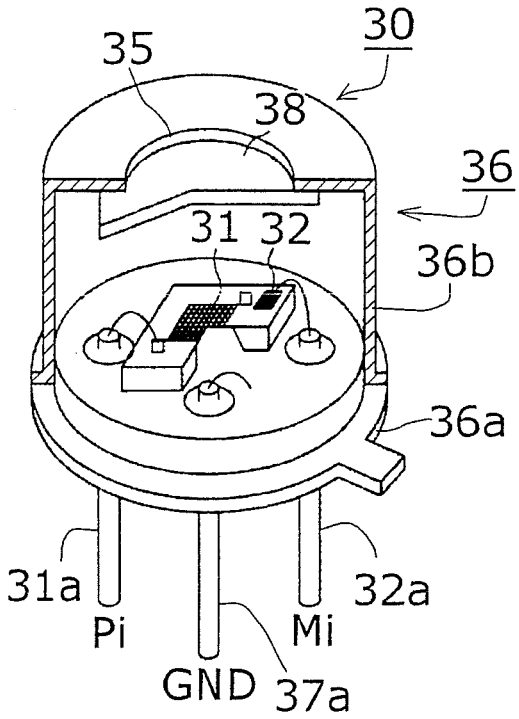
FIG. 5 is a diagram illustrating an internal structure of the infrared temperature sensor.
Figure 6:
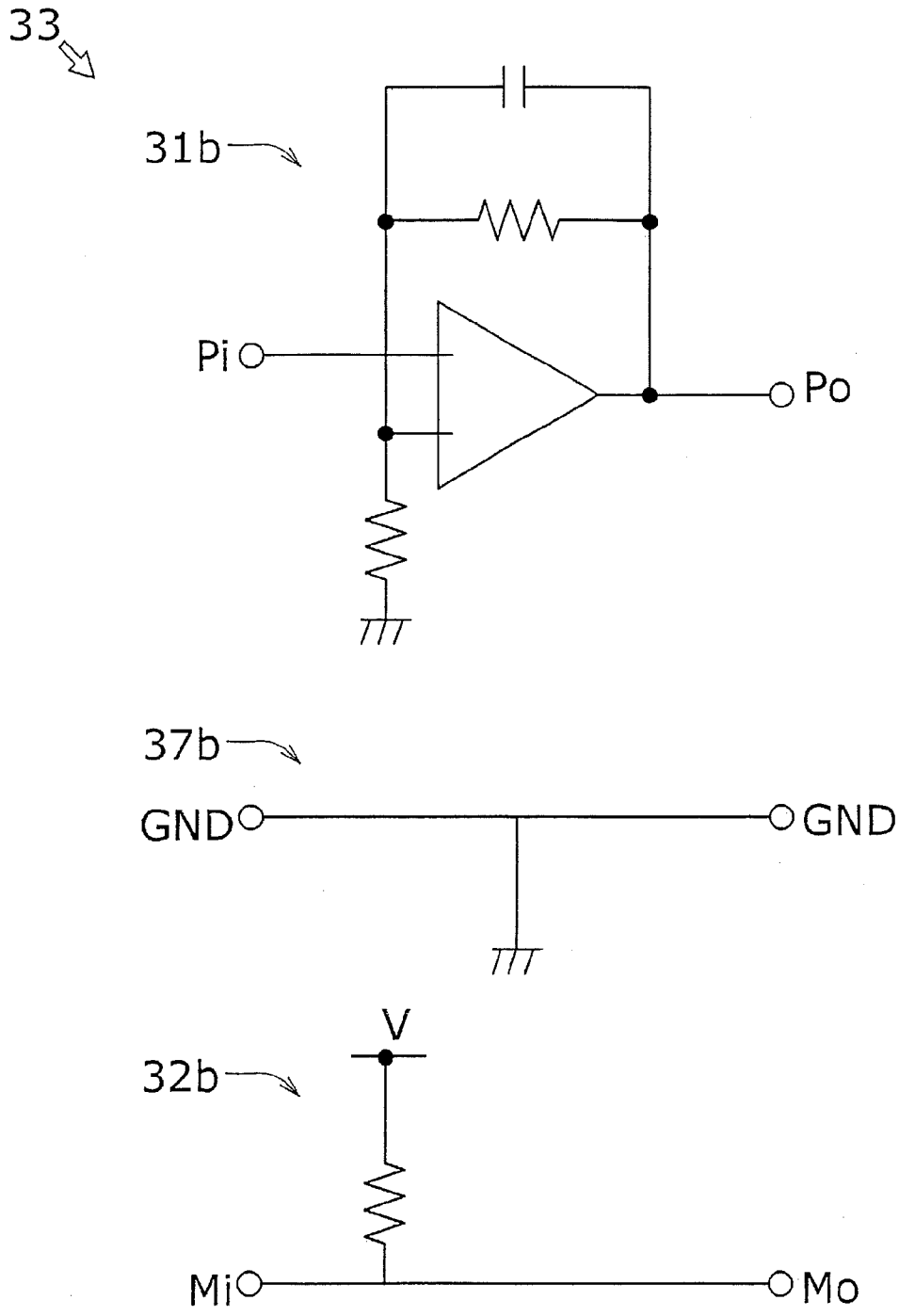
FIG. 6 is diagram illustrating an amplifier circuit of the infrared temperature sensor.

Referring to FIG. 4, FIG. 5 and FIG. 6, a structure of the infrared temperature sensor 30 of the present example will be described.

The infrared temperature sensor 30 includes: a thermopile 31; a thermistor 32; a can casing 36; and a lens 38. The thermopile 31 and the thermistor 32 are accommodated in the can casing 36. An opening window 35 is formed in the can casing 36, and the lens 38 is provided so as to close the opening window 35.

The can casing 36 includes: a casing seat 36*a*; and a cover 36*b*. The thermopile 31 and the thermistor 32 are fixed to a surface of the casing seat 36*a*. From a back face of the casing seat 36*a*, a terminal 31*a* of the thermopile 31, an output terminal 32*a* of the thermistor 32 and a GND output terminal 37*a* are extended.

Based on a dose of infrared rays incident upon the lens 38, the infrared temperature sensor 30 obtains information concerning the surface temperature of the heating roller 21. Detailed description will be made about this below.

The lens 38 receives part of the infrared rays radiated from the heating roller 21. The size and positioning of the lens 38 are set so that the infrared rays radiated only from a predetermined region of the surface of the heating roller 21 are incident upon the lens 38. The amount of infrared rays incident upon the lens 38 is increased as the surface temperature of the heating roller 21 is increased. The whole infrared rays incident upon the lens 38 are sent to the thermopile 31.

On an optical path from the lens 38 to the thermopile 31, an infrared-pass filter is provided. The infrared-pass filter is made of a material that allows at least infrared rays to pass therethrough, such as a silicon wafer, for example. Via the infrared-pass filter, only light of a wavelength range equivalent to that of infrared rays reaches the thermopile 31 from the lens 38.

The thermopile 31 includes a plurality of thermocouples. Each of the thermocouples has: a hot junction to which heat is applied upon reception of radiation of infrared rays; and a cold junction serving as a reference point. In this embodiment, the greater the amount of infrared rays incident upon the lens 38, the higher the temperature of the hot junction. Furthermore, a voltage responsive to a temperature difference between the hot junction and the cold junction is outputted from the output terminal 31*a*. With the aim of avoiding temperature fluctuations, the cold junction is connected to the infrared temperature sensor 30 itself (i.e., the casing seat 36*a*). However, temperature fluctuations of the cold junction are unavoidable. Therefore, the thermistor 32 is provided in order to detect a temperature of the cold junction. A voltage responsive to a temperature of the thermistor 32 is outputted from the output terminal 32*a*.

Relationship Between Amount of Infrared Rays and Surface Temperature of Heating Roller In this embodiment, a relationship of a temperature of an object to be measured (i.e., the surface temperature of the heating roller 21) and a temperature of the infrared temperature sensor 30 itself to an output voltage of the thermopile 31 is represented by the following equation:

$$E=A(Tx^4-Ty^4) \quad (1)$$

(where E denotes the output voltage of the thermopile, Tx denotes the temperature (K) of the object to be measured, Ty denotes the temperature (K) of the non-contact type temperature detector (infrared temperature sensor) itself, and A denotes a constant)

Tx (i.e., the temperature of the heating roller 21 serving as the object to be measured) can be calculated by measuring E and Ty using the above equation.

Moreover, the infrared temperature sensor 30 also has an amplifier circuit 33 illustrated in FIG. 6. Specifically, since the output voltage from the thermopile 31 is very low (which is 8 mV/200° C.), this output voltage has to be amplified to an A/D conversion level. A primary output Pi of the thermopile 31 is multiplied by an about 1000-fold gain by a circuit 31*b*, thereby obtaining a secondary output Po. The secondary output Po is outputted from the output terminal 31*a*. A GND output of the thermopile 31 is connected to the ground through a circuit 37*b*, and is outputted from the output terminal 37*a*.

Further, in the thermistor 32 for measuring the temperature of the infrared temperature sensor 30 itself, only a resistance value of the thermistor 32 is changed in accordance with the temperature. This resistance value change is converted into a voltage change. A primary output Mi of the thermistor 32 is varied by a resistor connected to a DC 5 V power supply in a circuit 32*b*, thereby obtaining a secondary output Mo as, a voltage. The secondary output Mo is outputted from the output terminal 32*a*.

These output voltages Po and Mo from the thermopile 31 and the thermistor 32 are surface temperature signals responsive to the surface temperature of the heating roller 21. The output voltages Po and Mo are subjected to A/D conversion by the A/D conversion PART 70 illustrated in FIG. 2. The A/D converted output voltages Po and Mo are inputted to the system controller 90. Using the A/D converted output voltages Po and Mo, the system controller 90 performs a computation based on the foregoing equation (1), thereby calculating the surface temperature of the heating roller 21.

Structure of Heat Receiving Body (Thermistor)

The thermistor 40 is a resistor having a high electric resistance change with respect to a temperature change. In accordance with a temperature of the thermistor 40, a resistance value of the thermistor 40 changes. Based on a change in the resistance value of the thermistor 40, information concerning the surface temperature of the heating roller 21 is obtained.

Relationship Between Temperature of Heat Receiving Body (Thermistor) and Surface Temperature of Heating Roller The thermistor 40 is heated by radiant heat from the heating roller 21 and convective heat conduction of air heated by the heating roller 21. Due to these actions, the temperature of the thermistor 40 is brought close to the surface temperature of the heating roller 21. In other words, it can be hypothesized that the surface temperature of the heating roller 21 and the temperature of the thermistor 40 are equal to each other. Therefore, a specific proportional relationship is also established between an output voltage of the thermistor 40 and the temperature of the object to be measured (i.e., the surface temperature of the heating roller 21).

Accordingly, the output voltage from the thermistor 40 is also a surface temperature signal responsive to the surface temperature of the heating roller 21. The output voltage of the thermistor 40 is subjected to A/D conversion by the A/D conversion PART 70 illustrated in FIG. 2. The A/D converted output voltage is inputted to the system controller 90. Using the A/D converted output voltage, the system controller 90 performs a computation based on the foregoing proportional relationship, thereby calculating the surface temperature of the heating roller 21.

First Temperature Detector and Second Temperature Detector

As described above, the system controller 90 is capable of detecting the surface temperature of the heating roller 21 in two kinds of methods by utilizing the infrared temperature sensor 30 or the thermistor 40.

In one method, a light receiving body and a first temperature detector are used. The light receiving body is the lens 38. The first temperature detector includes the thermopile 31, the thermistor 32, the A/D conversion PART 70 and the system controller 90. It should be noted that the A/D conversion PART 70 is not an essential element of the first temperature detector. The system controller 90 detects the surface temperature of the heating roller 21 based on the amount of infrared rays incident upon the lens 38 from the heating roller 21. In the following description, the surface temperature of the heating roller 21 obtained by the first temperature detector is defined as a first temperature T1.

In another method, a heat receiving body and a second temperature detector are used. The heat receiving body is the thermistor 40. In this method, a primary heated body means the heating roller 21. The second temperature detector includes the A/D conversion PART 70 and the system controller 90. It should be noted that the A/D conversion PART 70 is not an essential element of the second temperature detector. The system controller 90 detects the surface temperature of the heating roller 21 based on the temperature of the thermistor 40 heated by the heating roller 21. In the following description, the surface temperature of the heating roller 21 obtained by the second temperature detector is defined as a second temperature T2.

Detection Accuracy of First Temperature and Second Temperature

In regard to the first temperature T1 obtained using the infrared temperature sensor 30 and the second temperature T2 obtained using the thermistor 40, typical temperature detection accuracy and conditions thereof will be described.

The temperature detection accuracy of the first temperature T1 is roughly determined by the following two conditions, and typical values thereof are as follows:

(1) Contribution made by accuracy of the thermopile 31, the thermistor 32 and the amplifier circuit 33: ±0.5° C. which results from adjustment at the time of fabrication (2) Contribution made by accuracy of the A/D conversion PART 70: ±0.5° C.

The temperature detection accuracy of the first temperature T1 has a variation of ±1.0° C. as a whole.

The infrared temperature sensor 30 gathers, via the lens 38, infrared rays emitted from the surface of the heating roller 21. Therefore, variations in the distance between the heating roller 21 and the sensor 30 within a normal mounting tolerance will not cause a deviation in detected temperature. However, upon occurrence of condensation on the lens 38 and/or upon adhesion of attachment thereon, the amount of infrared rays transmitted through the lens 38 is decreased, and the detected temperature is deviated to a lower level. Condensation is caused by changes in a use environment of the image forming device. Attachment might be produced after a duration of operation (after secular changes). The magnitude of a deviation amount in the detected temperature depends on the extent of condensation and/or the amount of attachment. Accordingly, when environmental changes in use conditions are significant and/or in a worst situation where appropriate maintenance has not been performed, a very large deviation might also occur in the detected temperature.

On the other hand, the temperature detection accuracy of the second temperature T2 is determined by the following three conditions, and typical values thereof are as follows:

(1) Contribution made by accuracy of the thermistor 40: ±2.0° C.

(2) Contribution made by accuracy of the A/D conversion PART 70: ±0.5° C.

(3) Distance between the heating roller 21 and the thermistor 40: ±1° C. (with respect to a distance variation of 2.0 mm±0.2 mm)

The temperature detection accuracy of the second temperature T2 has a variation of ±3.5° C. as a whole. In this embodiment, the heating roller 21 and the thermistor 40 are located so as not to be in contact with each other, so that the distance between the heating roller 21 and the thermistor 40 falls within 2 mm, for example.

Advantages and Disadvantages of First Temperature Detector and Second Temperature Detector The infrared temperature sensor 30 obtains temperature-related information based on the amount of infrared rays radiated from the heating roller 21. Therefore, a responsiveness of the infrared temperature sensor 30 to a temperature change in the heating roller 21 is relatively high. On the other hand, in order to obtain temperature-related information, the thermistor 40 requires a time for heating the thermistor 40 to a temperature equal to that of the heating roller 21. Therefore, a responsiveness of the thermistor 40 to a temperature change in the heating roller 21 is relatively low. Furthermore, as mentioned above, in terms of accuracy of temperature detection, the infrared temperature sensor 30 is superior to the thermistor 40. However, the infrared temperature sensor 30 is inferior to the thermistor 40 in the following points. Upon occurrence of attachment (condensation and/or contamination) on the lens 38 of the infrared temperature sensor 30, infrared rays from the heating roller 21 are absorbed into the attachment of the lens 38. In this case, a temperature lower than an actual temperature is detected by the infrared temperature sensor 30. On the other hand, an output of the thermistor 40 is not much influenced by condensation and/or attachment.

Accordingly, as long as no attachment exists, the first temperature detector in which the infrared temperature sensor 30 is utilized is suitable for the detection of the surface temperature of the heating roller 21. On the other hand, when attachment has occurred on the lens 38, the second temperature detector in which the thermistor 40 is utilized is suitable for the detection of the surface temperature of the heating roller 21.

Temperature Controller

The system controller 90 executes temperature control for the heating roller 21 using the first temperature T1 or the second temperature T2. The temperature control performed using the first temperature T1 is first temperature control, and the temperature control performed using the second temperature T2 is second temperature control.

The system controller 90 selectively executes either the first temperature control or the second temperature control based on a comparison made between a detected temperature difference ΔT and a predetermined temperature difference PT. In this embodiment, the detected temperature difference ΔT refers to a difference (T1−T2) between the first temperature T1 and the second temperature T2.

In the present embodiment, the predetermined temperature difference PT=−30° C.

In the temperature control, the system controller 90 controls an output of the heating roller 21 so that the first temperature T1 or the second temperature T2 follows predetermined target temperatures. In the first temperature control, the output of the heating roller 21 is controlled by using the first temperature T1. More specifically, the system controller 90 first creates a control command for the heater control part 60. Subsequently, based on the control command, the heater control part 60 turns ON/OFF power fed to the halogen heater 80. In this embodiment, since the halogen heater 80 is AC-driven, the heater control part 60 internally includes a SSR (semiconductor relay).

In the present example, the control unit 18 (FIG. 1) is a control unit for performing centralized control for operations of the respective parts of the image forming device 1, and the system controller 90 is a temperature controller for controlling the surface temperature of the heating roller 21. The heater 80 also constitutes part of the image forming device 1.

Accordingly, the control unit 18 controls the heater 80 via the system controller 90. However, the present invention is not limited to such a structure.

Temperature Control

Figure 7:
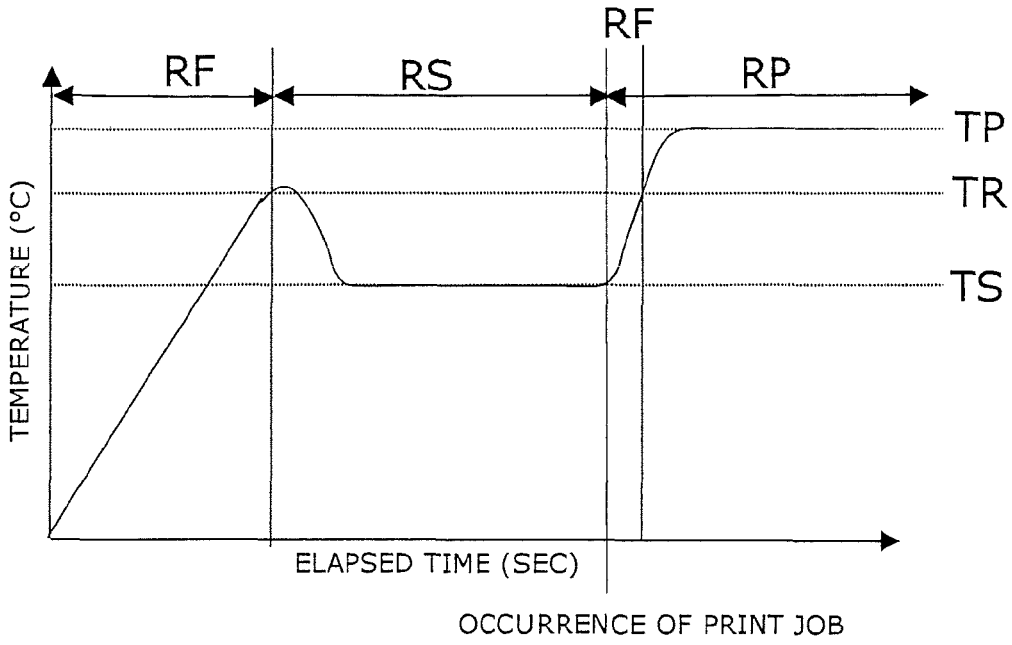
FIG. 7 is a graph illustrating transition of a surface temperature of a heating roller in exemplary temperature control.

Referring to FIG. 7, the temperature control for the heating roller 21, which is performed by the system controller 90, will be described.

The predetermined target temperatures for the surface temperature of the heating roller 21 includes a standby temperature TS, a fusing ready temperature TR and a print temperature TP. In this embodiment, the print temperature TP is a temperature suitable for execution of a print job. In the present example, the print temperature TP is set at 185° C. The standby temperature TS is a temperature lower than the print temperature TP. When there is no print job, the surface temperature of the heating roller 21 is maintained at the standby temperature TS so that the surface temperature of the heating roller 21 immediately reaches the print temperature TP. In the present example, the standby temperature TS is set at 160° C. The fusing ready temperature TR is a temperature between the standby temperature TS and the print temperature TP. In the present example, the fusing ready temperature TR is set at 175° C. Further, when the image forming device is in a state where the power is OFF, the surface temperature of the heating roller 21 corresponds to an indoor temperature TI. Upon turning ON of the power of the image forming device, the temperature control for the heating roller 21 is started.

In accordance with target temperature differences, the temperature control for the heating roller 21 is broadly divided into the following three types: start-up temperature control (region RF); standby temperature control (region RS); and print temperature control (region RP).

Furthermore, as mentioned above, the temperature control is divided into the two types, i.e., the first temperature control and the second temperature control, in accordance with sensor differences. Therefore, in the following description, when a distinction has to be made between the target temperature difference and the sensor difference for the temperature control, an expression such as "first start-up temperature control" will be used. The "first start-up temperature control" means start-up temperature control in which the infrared temperature sensor 30 is utilized.

In the start-up temperature control, the surface temperature of the heating roller 21 is increased to the fusing ready temperature TR from the indoor temperature TI or the standby temperature TS. The start-up temperature control is executed after activation achieved by turning ON of the power, or after the end of the standby temperature control. It should be noted that when a print job has occurred, the standby temperature control ends.

In the standby temperature control, the surface temperature of the heating roller 21 is decreased to the standby temperature TS from the fusing ready temperature TR or the print temperature TP and is then maintained at the standby temperature TS. The standby temperature control is executed after the end of the start-up temperature control when there is no print job, or after the end of the print temperature control. It should be noted that when the print job has ended, the print temperature control ends.

In the print temperature control, the surface temperature of the heating roller 21 is increased to the print temperature TP from the fusing ready temperature TR and is then maintained at the print temperature TP. The print temperature control is executed after the end of the start-up temperature control when a print job has occurred.

Control Details Responsive to State of Infrared Temperature Sensor

The system controller 90 judges a state of the infrared temperature sensor 30 based on a duration of the following formula: Detected Temperature Difference $\Delta T \geqq$ Predetermined Temperature Difference PT. The states of the infrared temperature sensor 30 include "normal state", "suspected condensation state", "suspected contamination state" and "contamination-determined state".

The counting of the duration is executed by the first timer 91 and the second timer 92. Both of the first timer 91 and the second timer 92 count the duration of the following formula: Detected Temperature Difference $\Delta T \geqq$ Predetermined Temperature Difference PT. However, operating conditions of the first timer 91 and the second timer 92 are different.

In a situation where condensation might occur on the lens 38, the first timer 91 starts counting from a time point at which the following formula holds: Detected Temperature Difference $\Delta T \geqq$ Predetermined Temperature Difference PT. Situations where occurrence of condensation is suspected include the following situations:

(First Situation): Although the second temperature control has been continued, the first temperature T1 has never reached any of the target temperatures (TR, TP and TS) yet. This means a situation where condensation has occurred after activation of the image forming device, and this condensation has not yet been eliminated by heat of the heating roller 21.

(Second Situation): The second temperature control is started after occurrence of a print job. This means a situation where condensation is caused by water vapor produced from a recording paper due to a print process.

Condensation is likely to occur when an abrupt environmental change has occurred, or in particular when the indoor temperature has sharply increased due to indoor heating or the like in an indoor environment during winter. Upon occurrence of condensation on the lens 38 of the infrared temperature sensor 30, infrared rays emitted from the heating roller 21 are blocked from the lens 38. As a result, the first temperature T1 obtained using the infrared temperature sensor 30, which is influenced by condensation, becomes lower than the second temperature obtained using the thermistor 40. Consequently, there occurs a situation (first situation) where the first temperature T1 does not reach any of the target temperatures (TR, TP and TS).

A time counted by the first timer 91 is a first elapsed time C1. When the first elapsed time C1 has reached a counting duration set for each situation, the first timer 91 stops counting, and the first elapsed time C1 is changed to 0. The counting duration of the first timer 91 is a first predetermined time. As the first predetermined time, a first long predetermined time P1L or a first short predetermined time P1S is used in accordance with the situation.

(First Situation): First long predetermined time P1L (Second Situation): First short predetermined time P1S In the present embodiment, the first long predetermined time P1L is set at 300 seconds. It should be noted that the first long predetermined time P1L, which is 300 seconds, is set based on a time required for condensation to be eliminated when the environment of the image forming device is changed from an LL (indoor temperature is 10° C./humidity is 15%) environment to an HH (indoor temperature is 30° C./humidity is 85%) environment. Furthermore, the first short predetermined time P1S is set at 30 seconds. A time required for condensation occurred immediately after printing to be eliminated is short because the temperature of the infrared temperature sensor 30 itself is also high. Therefore, the first short predetermined time P1S is set to be shorter than the first long predetermined time P1L.

In a situation where occurrence of contamination of the lens 38 is suspected, the second timer 92 starts counting from a time point at which the following formula holds: Detected Temperature Difference ΔT≧Predetermined Temperature Difference PT. Situations where occurrence of contamination is suspected include the following situations:

(Third Situation): The second temperature control is started in a state in which the first temperature has reached one of the target temperatures (TR, TP and TS) and then no print job occurs.

(Fourth Situation): The first elapsed time C1 has reached the first long predetermined time P1L in (First Situation).

(Fifth Situation): The first elapsed time C1 has reached the first short predetermined time P1S in (Second Situation).

In this embodiment, contamination is thought to occur in the following situation. For example, when attachment such as recording paper dust is accumulated on the lens 38 due to a long-term use, contamination occurs on the lens 38. Therefore, the third to fifth situations each indicate a state in which the heating roller 21 is sufficiently heated to the extent that condensation is eliminated, so that a distinction can be made between the third to fifth situations and the situation where condensation has occurred.

A time counted by the second timer 92 is a second elapsed time C2. When the second elapsed time C2 has reached a counting duration set for the third situation, the second timer 92 stops counting, and the second elapsed time C2 is changed to 0. The counting duration is given below.

(Third Situation): Second predetermined time P2

In the present embodiment, the second predetermined time P2 is set at 120 seconds.

(Normal State)

The "normal state" refers to a state in which neither condensation nor contamination has occurred on the lens 38. When the following conditions are satisfied, the state of the infrared temperature sensor 30 is determined as the "normal state".

$$\Delta T < PT \quad \text{(Condition 1)}$$

$$C1 = C2 = 0 \quad \text{(Condition 2)}$$

(Suspected Condensation State)

The "suspected condensation state" refers to a state in which occurrence of condensation on the lens 38 is suspected. When the following conditions are satisfied, the state of the infrared temperature sensor 30 is determined as the "suspected condensation state".

$$\Delta T \geqq PT \quad \text{(Condition 1)}$$

$$C1 \neq 0 \,\&\, C2 = 0 \quad \text{(Condition 2)}$$

(Suspected Contamination State)

The "suspected contamination state" refers to a state in which occurrence of contamination on the lens 38 is suspected. When the following conditions are satisfied, the state of the infrared temperature sensor 30 is determined as the "suspected contamination state".

$$\Delta T \geqq PT \quad \text{(Condition 1)}$$

$$C1 = 0 \,\&\, C2 \neq 0 \quad \text{(Condition 2)}$$

(Contamination-Determined State)

The "contamination-determined state" refers to a state in which occurrence of contamination on the lens 38 has been determined by the system controller 90. When the following conditions are satisfied, the state of the infrared temperature sensor 30 is determined as the "contamination-determined state".

$$\Delta T \geqq PT \quad \text{(Condition 1)}$$

$$C1 = 0 \,\&\, C2 = \text{P2} \quad \text{(Condition 2)}$$

When the second elapsed time C2 has reached the second predetermined time P2 in the "suspected contamination state", the "suspected contamination state" makes a transition to the "contamination-determined state". In the "contamination-determined state", the system controller 90 activates the alarm 29. A user is notified of occurrence of a defective condition using the alarm 29 because of the following reasons. When contamination is attached to the lens 38 instead of condensation, it is difficult to remove the contamination by a method other than cleaning of the lens 38. Furthermore, it is undesirable to continue the temperature control using the thermistor 40 having a low responsiveness. Moreover, in addition to activation of the alarm 29, the system controller 90 may shut off the supply of electric power to the heater 80 via the heater control part 60.

Start-Up Temperature Control

Referring to FIG. 8 to FIG. 12 and FIG. 13, the start-up temperature control will be described.

FIG. 8 to FIG. 12 each illustrate the start-up temperature control carried out from the activation, achieved by turning ON the power, to the start of the standby temperature adjustment control. It should be noted that examples depicted in FIG. 8 to FIG. 12 each illustrate a case where the start-up temperature control is executed concurrently with the activation of the image forming device. It should be noted that also after the standby temperature control, the start-up temperature control is executed before the print temperature control.

(Case where No Abnormality is Caused in Infrared Temperature Sensor)

Figure 8:
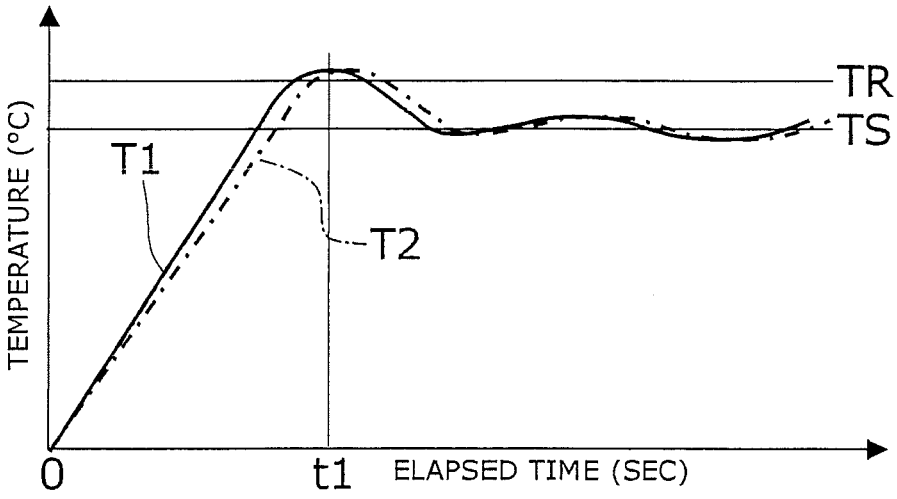
FIG. 8 is a graph illustrating changes in detected temperature in start-up temperature control when no abnormality is caused in the infrared temperature sensor.

Referring to FIG. 8, the start-up temperature control when no abnormality is caused in the infrared temperature sensor 30 will be described. In FIG. 8, the state of the infrared temperature sensor 30 is always the "normal state". Therefore, the first start-up temperature control, in which the infrared temperature sensor 30 is utilized, is executed. By the first start-up temperature control, the first temperature T1 reaches the fusing ready temperature TR at a time t1, and the first start-up temperature control ends. Subsequent to the time t1, first standby temperature control is executed.

(Case where Abnormality is Caused in Infrared Temperature Sensor)

Figure 9:
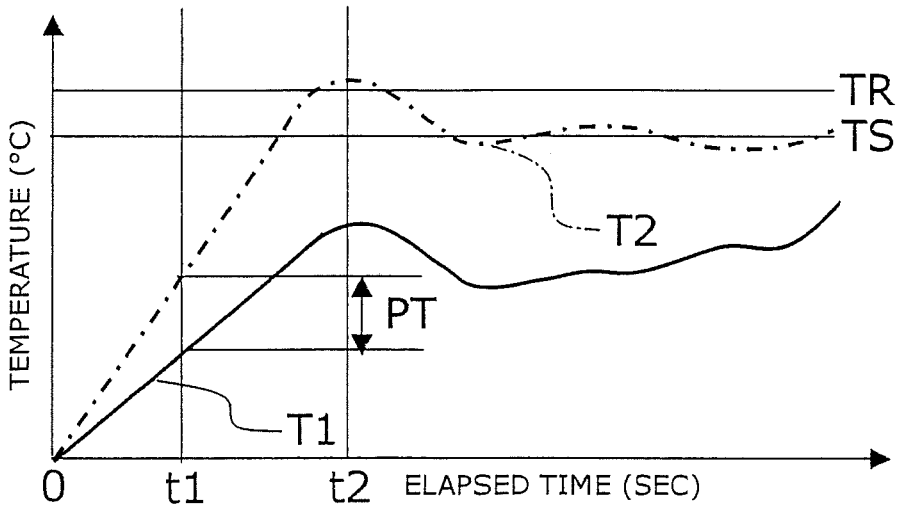
FIG. 9 is a graph illustrating changes in detected temperature when an abnormality caused in the infrared temperature sensor in start-up temperature control has not been eliminated.
Figure 10:
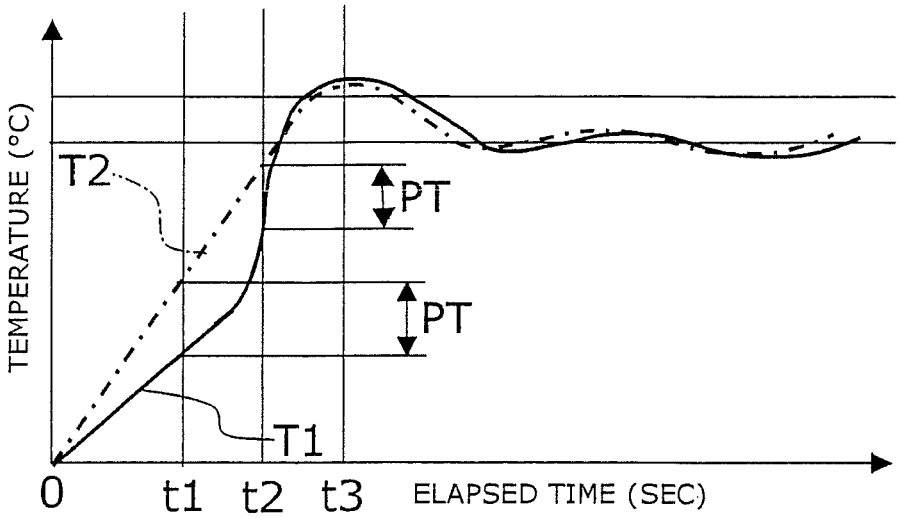
FIG. 10 is a graph illustrating changes in detected temperature when an abnormality caused in the infrared temperature sensor in start-up temperature control has been eliminated at some point.

Referring to FIG. 9 and FIG. 10, the start-up temperature control when an abnormality is caused in the infrared temperature sensor will be described.

The case illustrated in FIG. 9 provides a case where an abnormality occurred in the infrared temperature sensor 30 in the start-up temperature control has not been eliminated. The state of the infrared temperature sensor 30 is the "normal state" from a time 0 to a time t1, and is the "suspected condensation state" after the time t1. Until the time t1, the first start-up temperature control, in which the infrared temperature sensor 30 is utilized, is executed. Subsequent to the time t1, second start-up temperature control, in which the thermistor 40 is utilized, is executed. At a time t2 after the time t1, the second temperature reaches the fusing ready temperature TR. Subsequent to the time t2, second standby temperature control is executed.

The case illustrated in FIG. 10 provides a case where an abnormality occurred in the infrared temperature sensor 30 in the start-up temperature control has been eliminated at some point. The state of the infrared temperature sensor 30 is the "normal state" from a time 0 to a time t1, the "suspected condensation state" from the time t1 to a time t2, and the "normal state" after a time t3. Until the time t1, the first start-up temperature control, in which the infrared temperature sensor 30 is utilized, is executed. From the time t1 to the time t2, the second start-up temperature control, in which the thermistor 40 is utilized, is executed. Subsequent to the time t2, the first start-up temperature control is executed again. At the time t3 after the time t2, the second temperature reaches the fusing ready temperature TR. Subsequent to the time t3, the first standby temperature control is executed.

(Case where Abnormality is Caused in Infrared Temperature Sensor in Low Temperature Environment)

Figure 11:
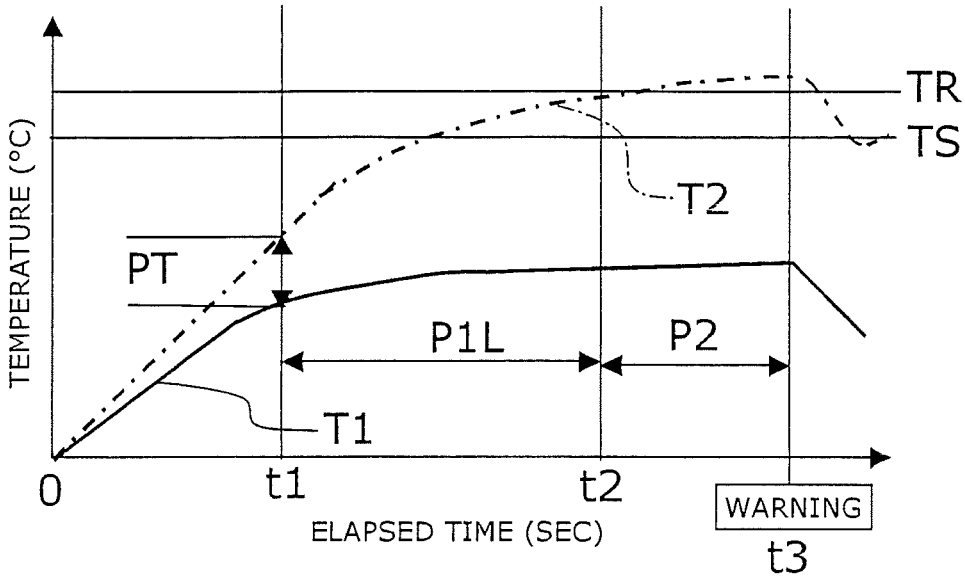
FIG. 11 is a graph illustrating changes in detected temperature when an abnormality caused in the infrared temperature sensor in start-up temperature control in a low temperature environment has not been eliminated.
Figure 12:
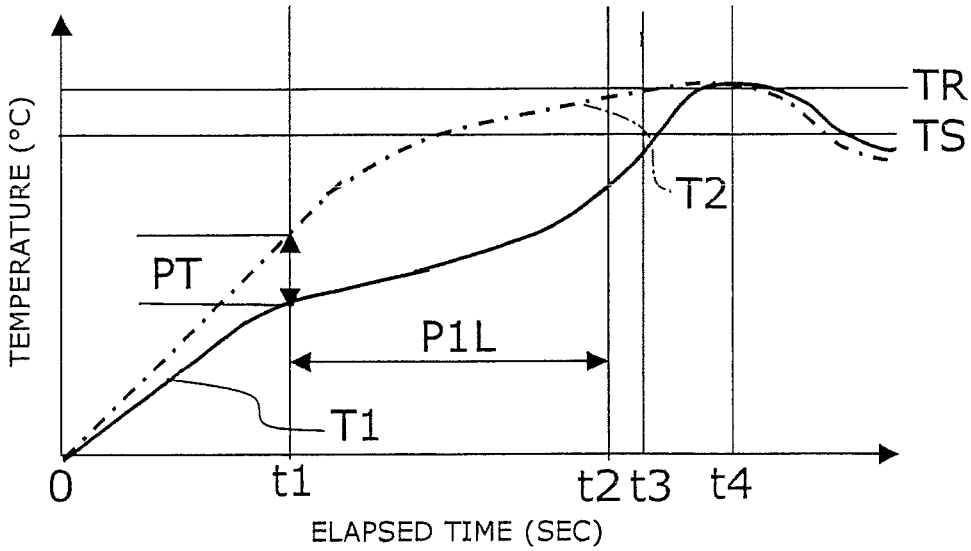
FIG. 12 a graph illustrating changes in detected temperature when an abnormality caused in the infrared temperature sensor in start-up temperature control in a low temperature environment has been eliminated at some point.

Referring to FIG. 11 and FIG. 12, the start-up temperature control when an abnormality is caused in the infrared temperature sensor in a low temperature environment will be described. FIG. 11 and FIG. 12 each illustrate a case where the image forming device is placed in a low temperature environment unlike the cases of FIG. 8 and FIG. 9. Therefore, temperature increase speeds of the first and second temperatures T1 and T2 are lower than those of the first and second temperatures T1 and T2 in the cases of FIG. 8 and FIG. 9.

As described above, condensation is expected to be eliminated upon lapse of the first long predetermined time P1L. When the detected temperature difference ΔT is greater than the predetermined temperature difference PT due to condensation, the detected temperature difference ΔT becomes less than the predetermined temperature difference PT upon elimination of the condensation. However, unlike the condensation, the contamination occurred on the lens 38 will not be eliminated by continuation of heat application to the heating roller 21.

The case illustrated in FIG. 11 provides a case where an abnormality occurred in the infrared temperature sensor 30 in a low temperature environment has not been eliminated. The state of the infrared temperature sensor 30 is the "normal state" from a time 0 to a time t1, the "suspected condensation state" from the time t1 to a time t2, the "suspected contamination state" from the time t2 to a time t3, and the "contamination-determined state" after the time t3. Until the time t1, the first start-up temperature control, in which the infrared temperature sensor 30 is utilized, is executed. Subsequent to the time t1, the second start-up temperature control, in which the thermistor 40 is utilized, is executed. In this case, a time width from the time t1 to the time t2 is the first long predetermined time P1L of the first timer 91, and a time width from the time t2 to the time t3 is the second predetermined time P2 of the second timer 92. At the time t3, the activation of the alarm 29 is started. Further, from the time t3, the supply of electric power to the heater 80 is stopped. In the case illustrated in FIG. 11, the start-up temperature control ends without allowing the first and second temperatures T1 and T2 to reach the fusing ready temperature TR.

The case illustrated in FIG. 12 provides a case where an abnormality occurred in the infrared temperature sensor 30 in a low temperature environment has been eliminated at some point. The state of the infrared temperature sensor 30 is the "normal state" from a time 0 to a time t1, the "suspected condensation state" from the time t1 to a time t2, the "suspected contamination state" from the time t2 to a time t3, and the "normal state" after the time t3. Until the time t1, the first start-up temperature control, in which the infrared temperature sensor 30 is utilized, is executed. From the time t1 to the time t3, the second start-up temperature control, in which the thermistor 40 is utilized, is executed. In this case, a time width from the time t1 to the time t2 is the first long predetermined time P1L. A time width from the time t2 to the time t3 is shorter than the second predetermined time P2. Subsequent to the time t3, the first start-up temperature control, in which the infrared temperature sensor 30 is utilized, is executed again. At a time t4 after the time t3, the first temperature T1 reaches the fusing ready temperature TR, and the first start-up temperature control ends. Subsequent to the time t4, the first standby temperature control is executed.

Figure 13:
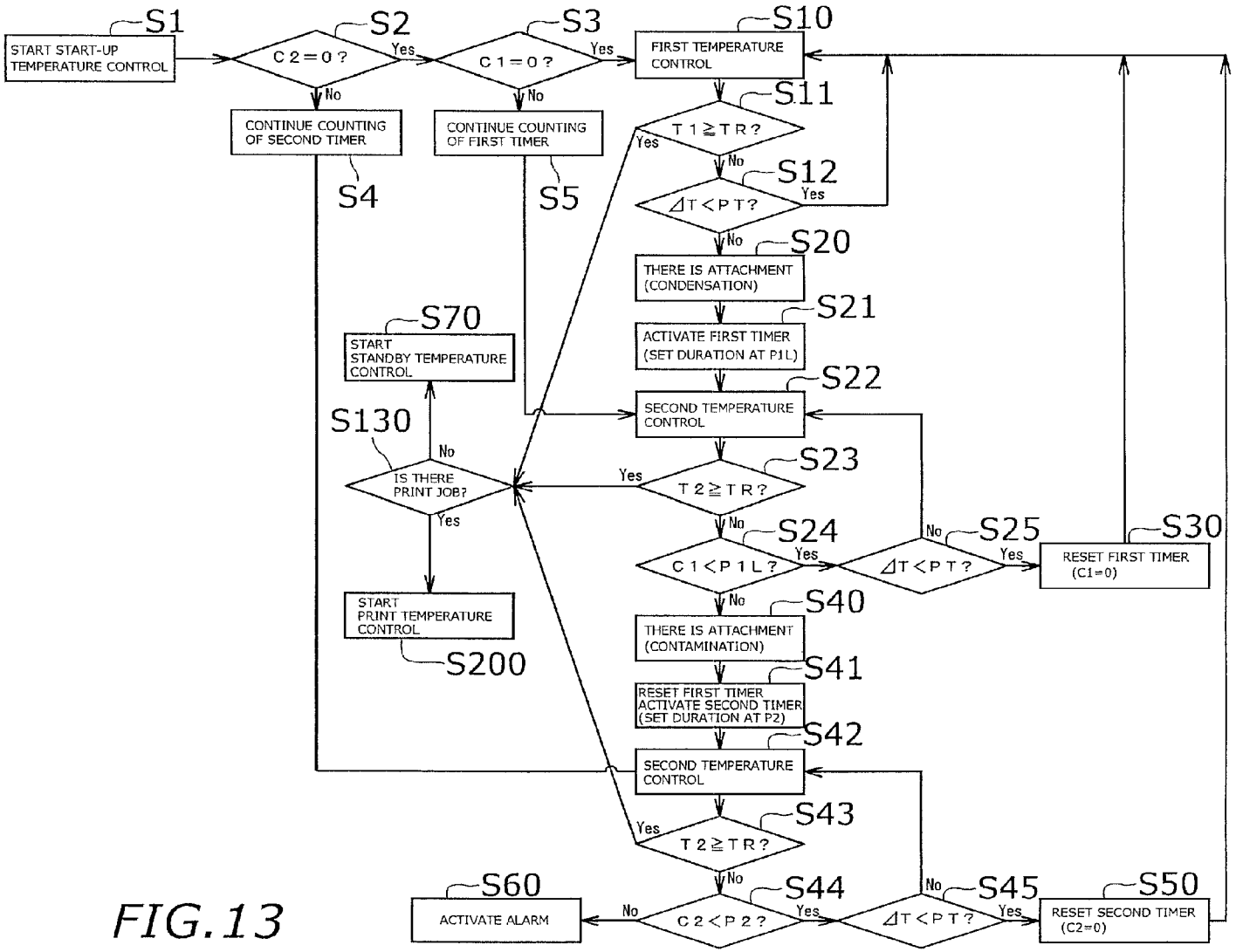
FIG. 13 is a flow chart of start-up temperature control.

Referring to FIG. 13, a flow of processing in the start-up temperature control will be described.

Concurrently with turning ON of the power, the system controller 90 starts the start-up temperature control (Step S1). Subsequently, the system controller 90 confirms whether or not the second elapsed time C2 is 0 (Step S2), and confirms whether or not the following equation holds: First Elapsed Time C1=0 (Step S3).

In the case of the "normal state" (C1=C2=0), the processing proceeds to a loop including Step S10 to Step S12. The loop including Step S10 to Step S12 is associated with the first temperature control. In the case of the "suspected condensation state" (C1≠0 & C2=0), the processing proceeds to a loop including Step S22 to Step S25 via Step S5. The loop including Step S22 to Step S25 is associated with the second temperature control. In Step S5, the system controller 90 causes the counting of the first timer 91 to be continued. In the case of the "suspected contamination state" (C1=0 & C2≠0), the processing proceeds to a loop including Step S42 to Step S45 via Step S4. The loop including Step S42 to Step S45 is associated with the second temperature control. In Step S4, the system controller 90 causes the counting of the second timer 92 to be continued.

The examples depicted in FIG. 8 to FIG. 12 each illustrate the case where the start-up temperature control is executed concurrently with the activation of the image forming device. Since this start-up temperature control is the initial temperature control after the activation, both of the first timer 91 and the second timer 92 do not carry out counting in this start-up temperature control. Therefore, both of the first elapsed time C1 and the second elapsed time C2 are 0. It should be noted that in the second and subsequent start-up temperature control, the first elapsed time C1 and the second elapsed time C2 are not necessarily 0.

The case where the processing has proceeded to the loop including Step S10 to Step S12 will be described. In the loop including Step S10 to Step S12, the first temperature control is executed. In Step S10, electric power is supplied to the heater 80 by the heater control part 60 so that the first temperature T1 becomes the fusing ready temperature TR. Further, during the execution of Step S10, Yes/No determinations of Step S11 and Step S12 are made for each given period of time. When the answer is Yes in Step S11 or the answer is No in Step S12, the loop including Step S10 to Step S12 ends. When the answer is No in Step S11 and the answer is Yes in Step S12, Step S10 is executed again. Then, the loop including Step S10 to Step S12 is continued.

In Step S11, it is determined whether or not the first temperature T1 is equal to or greater than the fusing ready temperature TR. When the answer is Yes in Step S11, the processing proceeds from Step S11 to Step S130. In Step S130, it is determined whether or not a print job has occurred. When the answer is No in Step S130, the start-up temperature control is ended, and the standby temperature control (FIG. 17) is newly started (Step S70). When the answer is Yes in Step S130, the start-up temperature control is ended, and the print temperature control (FIG. 21) is newly started (Step S200).

In Step S12, it is determined whether or not the detected temperature difference ΔT falls within the predetermined temperature difference PT. In other words, in Step S12, it is determined whether or not an abnormality exists in the infrared temperature sensor 30. When the answer is No in Step S12, the processing proceeds from Step S12 to Step S20.

When the processing has proceeded to Step S20, it is determined by the system controller 90 that condensation has temporarily occurred as attachment on the lens 38.

In Step S21 subsequent to Step S20, the first timer 91 is activated. Further, the counting duration of the first timer 91 is set at the first long predetermined time P1L (300 secs). Upon activation of the first timer 91, the processing proceeds to the loop including Step S22 to Step S25.

The case where the processing has proceeded to the loop including Step S22 to Step S25 will be described. In the loop including Step S22 to Step S25, the second temperature control, in which the thermistor 40 is utilized, is executed. In Step S22, electric power is supplied to the heater 80 by the heater control part 60 so that the second temperature T2 becomes the fusing ready temperature TR. Furthermore, during the execution of Step S22, Yes/No determinations of Step S23, Step S24 and Step S25 are made for each given period of time. When the answer is Yes in Step S23, the answer is No in Step S24 or the answer is Yes in Step S25, the loop of the second temperature control ends. When the answer is No in Step S23, the answer is Yes in Step S24 and the answer is No in Step S25, Step S22 is executed again.

In Step S23, similarly to Step S11, it is determined whether or not the second temperature T2 is equal to or greater than the fusing ready temperature TR. When the answer is Yes in Step S23, the processing proceeds from Step S23 to Step S130.

In Step S24, it is determined whether or not the first elapsed time C1 falls within the first long predetermined time P1L. When the answer is No in Step S23, the processing proceeds from Step S23 to Step S40.

The condensation of the lens 38 is eliminated when the infrared temperature sensor 30 itself is heated by radiant heat of the heating roller 21. Therefore, in Step S25, it is determined whether or not the detected temperature difference ΔT is less than the predetermined temperature difference PT. When the answer is Yes in Step S25, the processing proceeds from Step S25 to Step S30. In Step S30, the first elapsed time C1 is reset to 0. Subsequently, the processing proceeds from Step S30 to Step S10. Thus, upon returning of the detected temperature difference ΔT within the predetermined temperature difference PT, the second temperature control is switched to the first temperature control.

When the processing has proceeded to Step S40, it is determined by the system controller 90 that contamination has occurred as attachment on the lens 38.

In Step S41 subsequent to Step S40, the first timer 91 is stopped and reset. Further, the second timer 92 is activated. The counting duration of the second timer 92 is set at the second predetermined time P2 (120 secs). Then, the processing proceeds to the loop including Step S42 to Step S45.

The case where the processing has proceeded to the loop including Step S42 to Step S45 will be described. In the loop including Step S42 to Step S45, the second temperature control, in which the thermistor 40 is utilized, is continuously executed. The loop including Step S42 to Step S45 is basically similar to the loop including Step S22 to Step S25. In Step S42, electric power is supplied to the heater 80 by the heater control part 60 so that the second temperature T2 becomes the fusing ready temperature TR. Furthermore, during the execution of Step S42, Yes/No determinations of Step S43, Step S44 and Step S45 are made for each given period of time. When the answer is Yes in Step S43, the answer is No in Step S44 or the answer is Yes in Step S45, the loop of the second temperature control ends. When the answer is No in Step S43, the answer is Yes in Step S44 and the answer is No in Step S45, Step S42 is executed again.

In Step S43, similarly to Steps S11 and S23, it is determined whether or not the second temperature T2 is equal to or greater than the fusing ready temperature TR. When the answer is Yes in Step S43, the processing proceeds from Step S43 to Step S130.

In Step S44, it is determined whether or not the second elapsed time C2 falls within the second predetermined time P2. When the answer is No in Step S44, the processing proceeds from Step S44 to Step S60.

When the processing has proceeded to Step S60, the system controller 90 activates the alarm 29.

Even when the processing has proceeded to the loop including Step S42 to Step S45, the condensation of the lens 38 might be eliminated. Therefore, in Step S45, it is determined whether or not the detected temperature difference ΔT is less than the predetermined temperature difference PT. When the answer is Yes in Step S45, the processing proceeds from Step S45 to Step S50. In Step S50, the second elapsed time C2 is reset to 0. Subsequently, the processing proceeds from Step S50 to Step S10.

Standby Temperature Control

Next, referring to FIG. 14 to FIG. 16 and FIG. 17, the standby temperature control will be described.

(Case where No Abnormality is Caused in Infrared Temperature Sensor)

Figure 14:
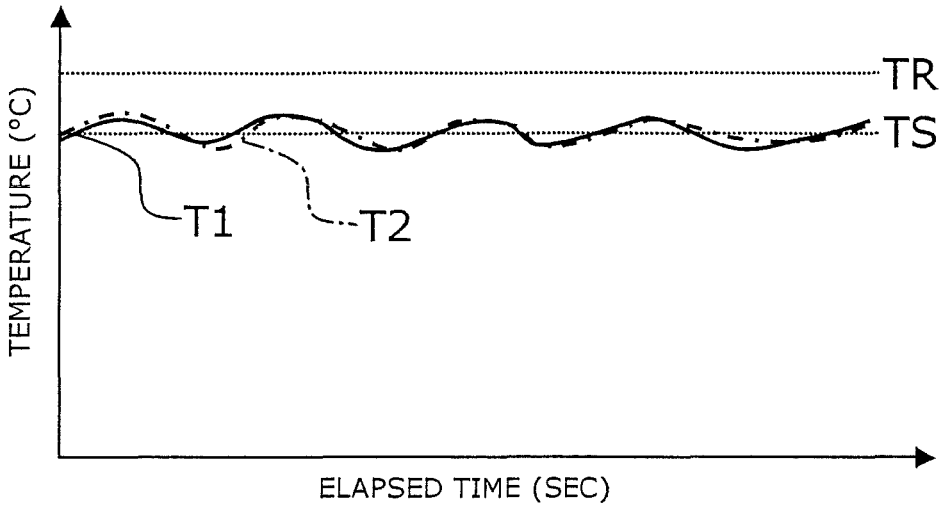
FIG. 14 is a graph illustrating changes in detected temperature in standby temperature control when no abnormality is caused in the infrared temperature sensor.

Referring to FIG. 14, the standby temperature control when no abnormality is caused in the infrared temperature sensor 30 will be described. In FIG. 14, the state of the infrared temperature sensor 30 is always the "normal state". Therefore, the first standby temperature control, in which the infrared temperature sensor 30 is utilized, is executed.

(Case where Abnormality is Caused in Infrared Temperature Sensor after Start of Standby Temperature Control)

Figure 15:
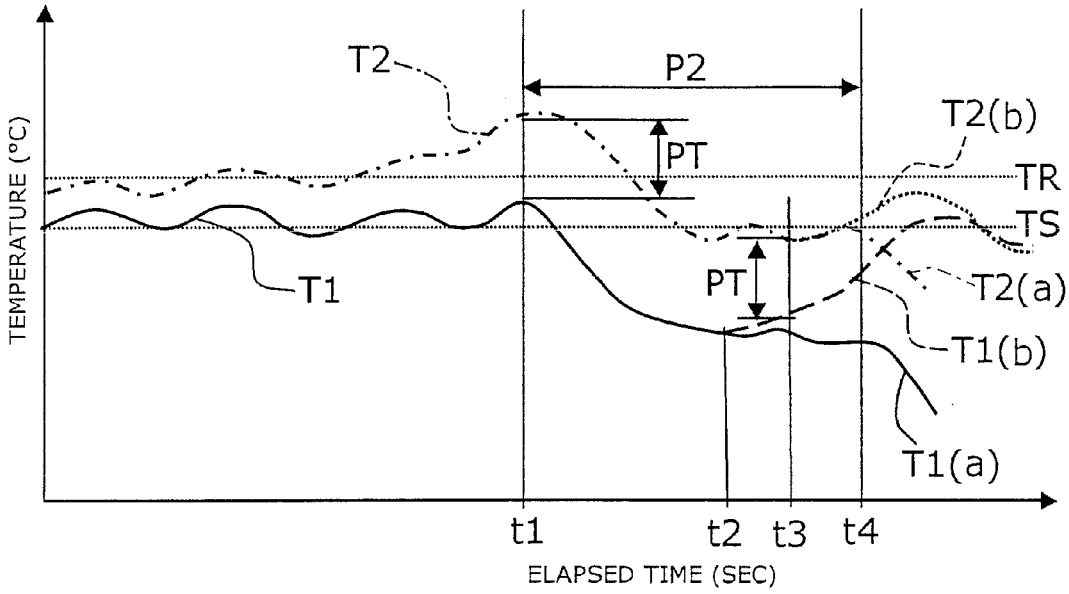
FIG. 15 is a graph illustrating changes in detected temperature when an abnormality has been caused in the infrared temperature sensor after start of standby temperature control.

Referring to FIG. 15, a case where an abnormality is caused in the infrared temperature sensor 30 after the start of the standby temperature control will be described.

FIG. 15 illustrates two types of temperature changes in the first temperature T1 obtained by the infrared temperature sensor 30. A graph of the first temperature T1 is branched into a graph of a first temperature T1(*a*) and a graph of a first temperature T1(*b*) at a time t2. The graph of the first temperature T1(*a*) illustrates a case where the abnormality in the infrared temperature sensor 30 has not been eliminated. The graph of the first temperature T1(*b*) illustrates a case where the abnormality in the infrared temperature sensor 30 has been eliminated at some point. For example, when the contamination (recording paper dust) on the lens 38 has been removed by airflow, vibration of the image forming device, etc., the abnormality in the infrared temperature sensor 30 is eliminated at some point. Furthermore, the second temperature T2 is also branched into a graph of T2(*a*) and a graph of T2(*b*) in accordance with the branching of the first temperature T1. It should be noted that T2 changes in accordance with T1 because the detected temperature utilized in the temperature control is switched between T1 and T2 depending on the magnitude of the detected temperature difference ΔT.

The case where T1 and T2 are changed to T1(*a*) and T2(*a*), respectively, will be described. The state of the infrared temperature sensor 30 is the "normal state" from a time 0 to a time t1, the "suspected contamination state" from the time t1 to a time t4, and the "contamination-determined state" after the time t4. Until the time t1, the first standby temperature control, in which the infrared temperature sensor 30 is utilized, is executed. From the time t1 to the time t4, the second standby temperature control, in which the thermistor 40 is utilized, is executed. In this case, a time width from the time t1 to a time t4 is the second predetermined time P2 of the second timer 92. At the time t4, the alarm 29 is activated, and the supply of electric power to the heater 80 is stopped.

In FIG. 15, the state of the infrared temperature sensor 30 makes a transition from the "normal state" to the "suspected contamination state" directly without going through the "suspected condensation state". This is due to the following reasons. When the state of the infrared temperature sensor 30 is the "normal state" at the start of the standby temperature control, it means that the start-up temperature control has ended in the "normal state". Accordingly, even if condensation has occurred in the start-up temperature control, the condensation is eliminated by the time at which the standby temperature control starts. Therefore, occurrence of condensation is unconceivable after the start of the standby temperature control.

The case where T1 and T2 are changed to T1(*b*) and T2(*b*), respectively, will be described. The state of the infrared temperature sensor 30 is the "normal state" from the time 0 to the time t1, the "suspected contamination state" from the time t1 to the time t3, and the "normal state" after the time t3. Until the time t1, the first standby temperature control, in which the infrared temperature sensor 30 is utilized, is executed. From the time t1 to the time t3, the second standby temperature control, in which the thermistor 40 is utilized, is executed. After the time t3, the first standby temperature control, in which the infrared temperature sensor 30 is utilized, is executed again.

(Case where Abnormality is Caused in Infrared Temperature Sensor from Start of Standby Temperature Control)

Figure 16:
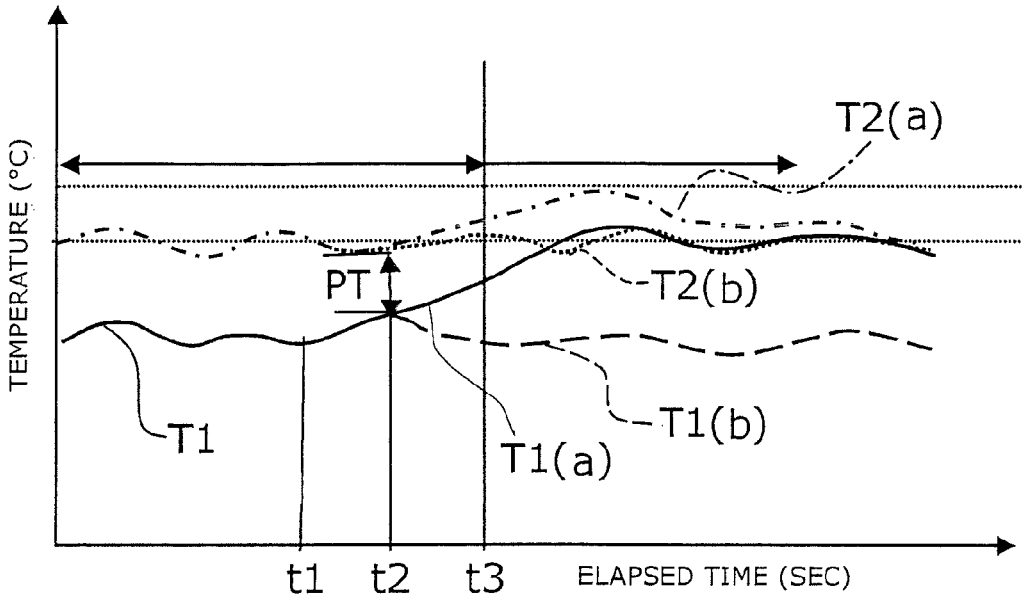
FIG. 16 is a graph illustrating changes in detected temperature when an abnormality has been caused in the infrared temperature sensor since start of standby temperature control.

Referring to FIG. 16, a case where an abnormality is caused in the infrared temperature sensor from the start of the standby temperature control will be described.

FIG. 16 illustrates two types of temperature changes in the first temperature T1 obtained by the infrared temperature sensor 30. A graph of the first temperature T1 is branched into a graph of a first temperature T1(*a*) and a graph of a first temperature T1(*b*) at a time t2. The graph of the first temperature T1(*a*) illustrates a case where the abnormality in the infrared temperature sensor 30 has been eliminated at some point. The graph of the first temperature T1(*b*) illustrates a case where the abnormality in the infrared temperature sensor 30 has not been eliminated. Furthermore, the second temperature T2 is also branched into a graph of T2(*a*) and a graph of T2(*b*) in accordance with the branching of the first temperature T1.

The case where T1 and T2 are changed to T1(*a*) and T2(*a*), respectively, will be described. The state of the infrared temperature sensor 30 is the "suspected condensation state" from a time 0 to a time t2, and the "normal state" after the time t2. Until the time t2, the second standby temperature control, in which the thermistor 40 is utilized, is executed. After the time t2, the first standby temperature control, in which the infrared temperature sensor 30 is utilized, is executed.

The case where T1 and T2 are changed to T1(*b*) and T2(*b*), respectively, will be described. The state of the infrared temperature sensor 30 is the "suspected condensation state" from the time 0 to a time t3, and the "suspected contamination state" after the time t3. The second standby temperature control, in which the thermistor 40 is utilized, is executed. It should be noted that if the state where the detected temperature difference ΔT is high is continued beyond the second predetermined time P2 after the time t3, the "suspected contamination state" makes a transition to the "contamination-determined state".

Figure 17:
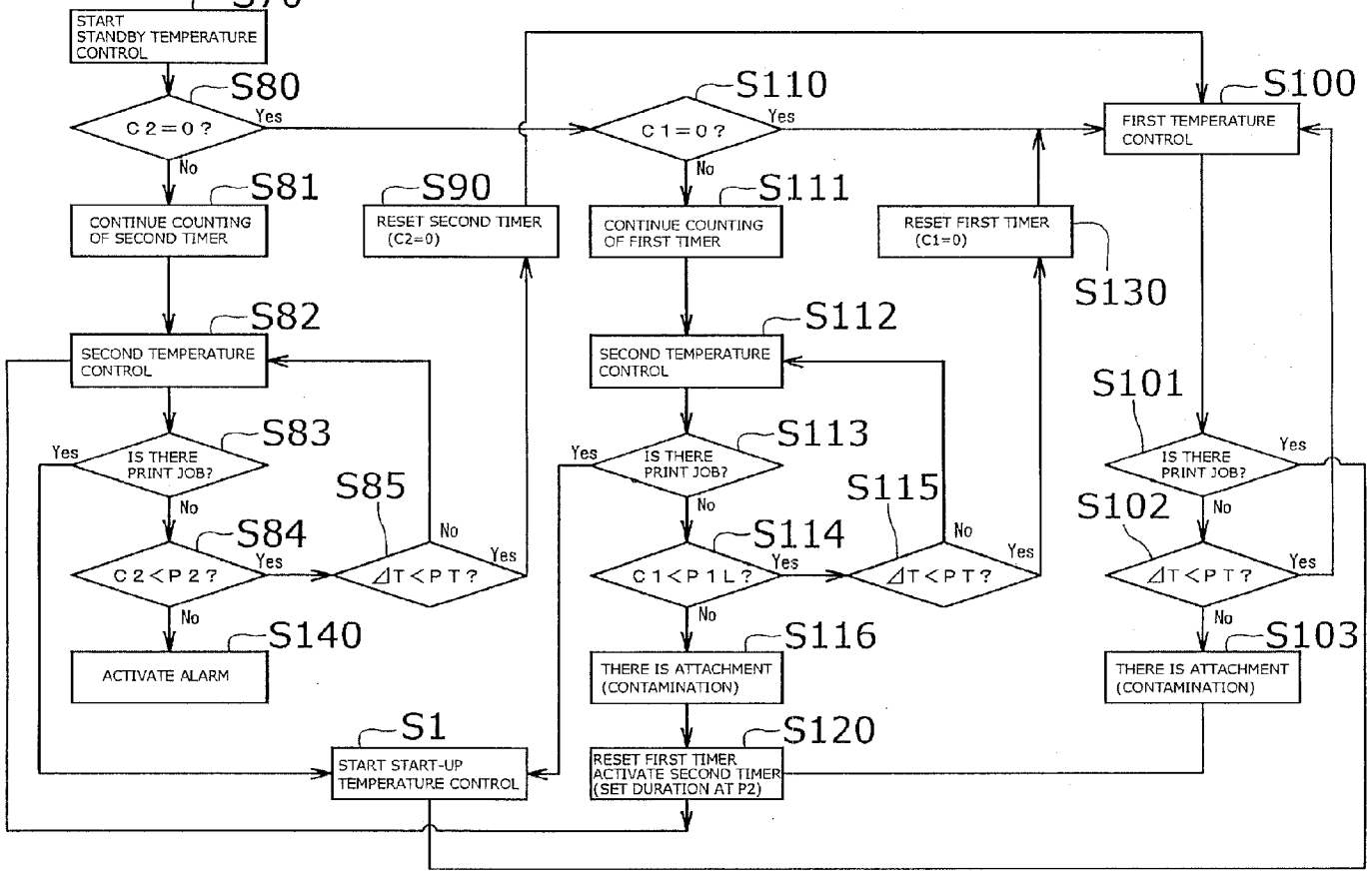
FIG. 17 is a flow chart of standby temperature control.

Referring to FIG. 17, a flow of processing in the standby temperature control will be described.

Upon start of the standby temperature control (Step S70), the system controller 90 acquires information on the state of the infrared temperature sensor 30. In other words, the system controller 90 confirms whether or not the second elapsed time C2 is 0 (Step S80), and confirms whether or not the following equation holds: First Elapsed Time C1=0 (Step S110).

In the case of the "normal state" (C1=C2=0), the processing proceeds to a loop including Step S100 to Step S102. The loop including Step S100 to Step S102 is associated with the first temperature control. In the case of the "suspected condensation state" (C1≠0 & C2=0), the processing proceeds to a loop including Step S112 to Step S115 via Step S111. The loop including Step S112 to Step S115 is associated with the second temperature control. In Step S111, the system controller 90 causes the counting of the first timer 91 to be continued. In the case of the "suspected contamination state" (C1=0 & C2≠0), the processing proceeds to a loop including Step S82 to Step S85 via Step S81. The loop including Step S82 to Step S85 is associated with the second temperature control. In Step S81, the system controller 90 causes the counting of the second timer 92 to be continued.

The case where the processing has proceeded to the loop including Step S100 to Step S102 will be described. In the loop including Step S100 to Step S102, the first temperature control, in which the infrared temperature sensor 30 is utilized, is executed. In Step S100, electric power is supplied to the heater 80 by the heater control part 60 so that the first temperature T1 is maintained at the standby temperature TS. Further, during the execution of Step S100, Yes/No determinations of Step S101 and Step S102 are made for each given period of time. When the answer is Yes in Step S101 or the answer is No in Step S102, the loop including Step S100 to Step S102 ends. When the answer is No in Step S101 and the answer is Yes in Step S102, Step S100 is executed again. Then, the loop including Step S100 to Step S102 is continued.

In Step S101, it is determined whether or not a print job has occurred. When the answer is Yes in Step S101, the standby temperature control is ended, and the start-up temperature control (FIG. 13) is newly started (Step S1). It should be noted that the start-up temperature control is inevitably executed prior to the print temperature control.

In Step S102, it is determined whether or not the detected temperature difference ΔT falls within the predetermined temperature difference PT. When the answer is No in Step S102, the processing proceeds to Step S103.

When the processing has proceeded to Step S103, it is determined by the system controller 90 that contamination has occurred as attachment on the lens 38. As mentioned above, in the state where C1=C2=0 and the standby temperature control is executed, no condensation will occur on the lens 38. Accordingly, it is immediately determined that contamination has occurred.

In Step S120 subsequent to Step S103, the first timer 91 is stopped and reset. Further, the second timer 92 is activated. Then, the processing proceeds to the loop including Step S82 to Step S85.

The case where the processing has proceeded to the loop including Step S82 to Step S85 will be described. In the loop including Step S82 to Step S85, the second temperature control, in which the thermistor 40 is utilized, is executed. In Step S82, electric power is supplied to the heater 80 by the heater control part 60 so that the second temperature T2 becomes the standby temperature TS. Furthermore, during the execution of Step S82, Yes/No determinations of Step S83, Step S84 and Step S85 are made for each given period of time. When the answer is Yes in Step S83, the answer is No in Step S84 or the answer is Yes in Step S85, the loop including Step S82 to Step S85 ends. When the answer is No in Step S83, the answer is Yes in Step S84 and the answer is No in Step S85, Step S82 is executed again. Then, the loop including Step S82 to Step S85 is continued.

In Step S83, it is determined whether or not a print job has occurred. When the answer is Yes in Step S83, the standby temperature control is ended, and the start-up temperature control (FIG. 13) is newly started (Step S1).

In Step S84, it is determined whether or not the second elapsed time C2 falls within the second predetermined time P2. When the answer is No in Step S84, the processing proceeds from Step S84 to Step S140. When the processing has proceeded to Step S140, the system controller 90 activates the alarm 29 in a manner similar to that in Step S60. Furthermore, the supply of power to the heater 80 is also stopped.

In Step S85, it is determined whether or not the detected temperature difference ΔT falls within the predetermined temperature difference PT. When the answer is Yes in Step S85, the processing proceeds to Step S90. In Step S90, the second elapsed time C2 is reset to 0. Subsequently, the processing proceeds from Step S90 to Step S100. Thus, upon returning of the detected temperature difference ΔT within the predetermined temperature difference PT, the second temperature control is switched to the first temperature control.

The case where the processing has proceeded to the loop including Step S112 to Step S115 will be described. In the loop including Step S112 to Step S115, the second temperature control, in which the thermistor 40 is utilized, is executed. In Step S112, electric power is supplied to the heater 80 by the heater control part 60 so that the second temperature T2 becomes the standby temperature TS. Furthermore, during the execution of Step S112, Yes/No determinations of Step S113, Step S114 and Step S115 are made for each given period of time. When the answer is Yes in Step S113, the answer is No in Step S114 or the answer is Yes in Step S115, the loop including Step S112 to Step S115 ends. When the answer is No in Step S113, the answer is Yes in Step S114 and the answer is No in Step S115, Step S112 is executed again. Then, the loop including Step S112 to Step S115 is continued.

In Step S113, it is determined whether or not a print job has occurred. When the answer is Yes in Step S113, the standby temperature control is ended, and the start-up temperature control (FIG. 13) is newly started (Step S1).

In Step S114, it is determined whether or not the first elapsed time C1 falls within the first long predetermined time P1L. When the answer is No in Step S114, the processing proceeds from Step S114 to Step S116. When the processing has proceeded to Step S116, similarly to Step S40, it is determined by the system controller 90 that contamination has occurred as attachment on the lens 38. Then, the processing proceeds to Step S120.

In Step S115, it is determined whether or not the detected temperature difference ΔT falls within the predetermined temperature difference PT. When the answer is Yes in Step S115, the processing proceeds to Step S130. In Step S130, the first elapsed time C1 is reset to 0. Subsequently, the processing proceeds to Step S100. Thus, upon returning of the detected temperature difference ΔT within the predetermined temperature difference PT, the second temperature control is switched to the first temperature control.

Print Temperature Control

Next, referring to FIG. 18 to FIG. 20 and FIG. 21, the print temperature control will be described.

When a print job occurs (FIG. 21: the answer is No in Step S403 and Step S501), no determination is made on the state of the infrared temperature sensor 30 in the print temperature control. Processing of the print job is preferentially executed.

(Case where No Abnormality is Caused in Infrared Temperature Sensor)

Figure 18:
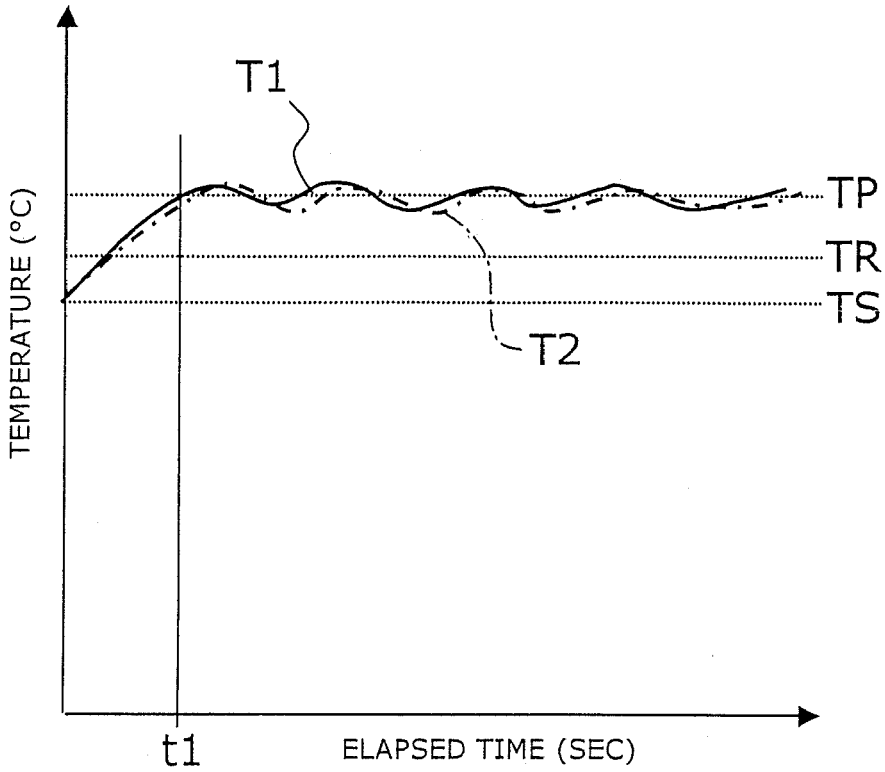
FIG. 18 is a graph illustrating changes in detected temperature in print temperature control when no abnormality is caused in the infrared temperature sensor.

Referring to FIG. 18, the print temperature control when no abnormality is caused in the infrared temperature sensor 30 will be described. In FIG. 18, a state in which detected temperature difference ΔT<predetermined temperature difference PT is always maintained. Therefore, first print temperature control, in which the infrared temperature sensor 30 is utilized, is executed. It should be noted that the start-up temperature control is executed until a time t1, and the print temperature control is executed after the time t1.

(Case where Abnormality is Caused in Infrared Temperature Sensor after Start of Print Temperature Control)

Figure 19:
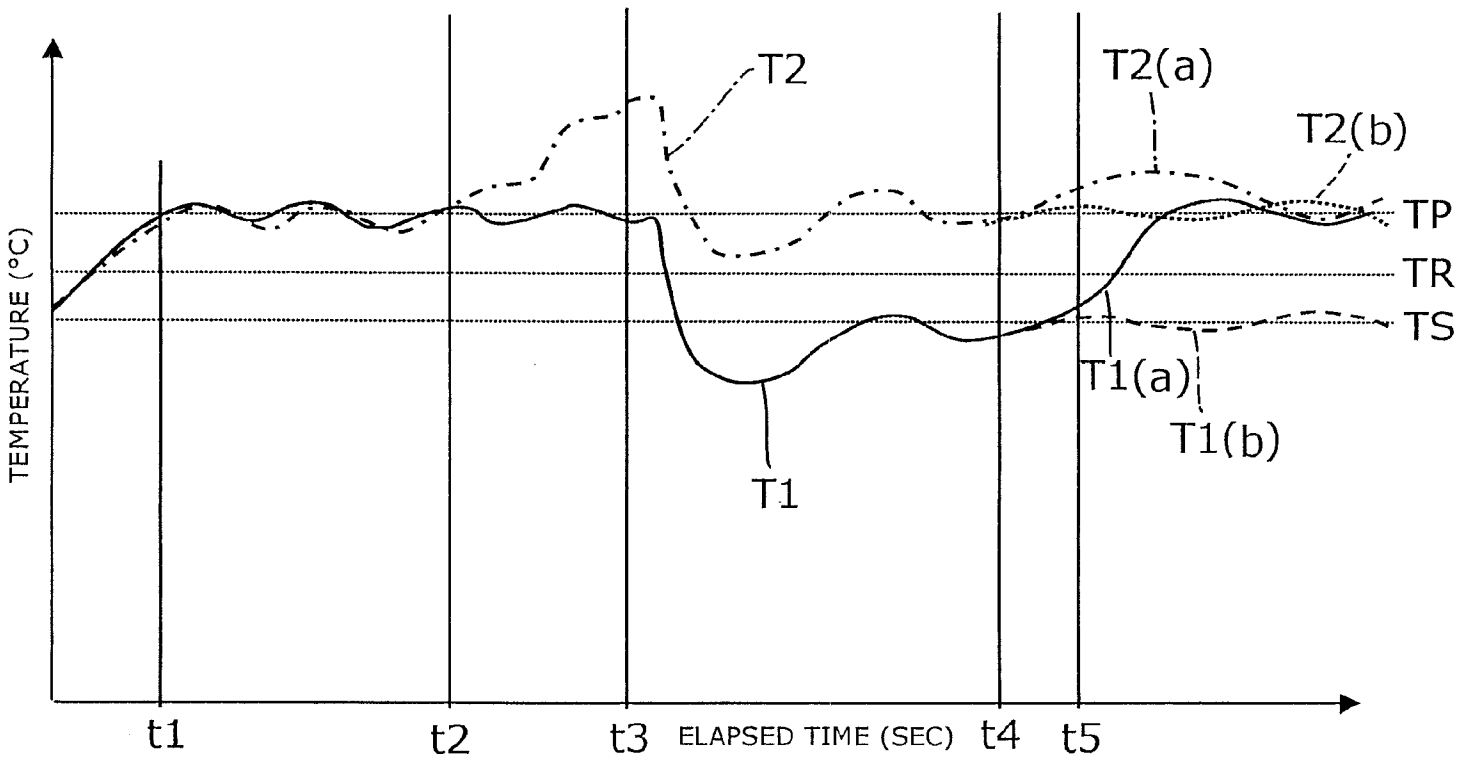
FIG. 19 is a graph illustrating changes in detected temperature when an abnormality has been caused in the infrared temperature sensor after start of print temperature control.

Referring to FIG. 19, a case where an abnormality is caused in the infrared temperature sensor 30 after the start of the print temperature control will be described. The first start-up temperature control is executed until a time t1, and the print temperature control is executed after the time t1.

FIG. 19 illustrates two types of temperature changes in the first temperature T1 obtained by the infrared temperature sensor 30. A graph of the first temperature T1 is branched into a graph of a first temperature T1(*a*) and a graph of a first temperature T1(*b*) at a time t4. The graph of the first temperature T1(*a*) illustrates a case where the abnormality in the infrared temperature sensor 30 has been eliminated at some point. The graph of the first temperature T1(*b*) illustrates a case where the abnormality in the infrared temperature sensor 30 has not been eliminated. Furthermore, the second temperature T2 is also branched into a graph of T2(*a*) and a graph of T2(*b*) in accordance with the branching of the first temperature T1.

FIG. 19 illustrates the following situation, for example. At a time t2, contamination (adhesion of recording paper dust) has occurred on the lens 38, and ΔT is increased after the time t2. As a result, ΔT exceeds PT at a time t3.

The case where T1 and T2 are changed to T1(*a*) and T2(*a*), respectively, will be described. In this case, for example, a slip of recording paper is stuck to the lens 38 instead of recording paper dust, and/or condensation is caused by moisture contained in the recording paper P. The condensation is eliminated upon increase of heating time. Further, a slip of recording paper stuck to the lens 38 might be removed by airflow. In other words, the abnormality in the infrared temperature sensor 30 is eliminated at some point. ΔT<PT from the time t1 to the time t3, and ΔT≧PT from the time t3 to a time t5. T1(*a*) and T2(*a*) are similar to T1 and T2 so far. However, in the cases of T1(*a*) and T2(*a*), ΔT<PT after the time t5. Therefore, after the time t5, the first print temperature control is executed instead of second print temperature control.

The cases of T1(*a*) and T2(*a*) each illustrate the following situation, for example. The contamination of the lens 38 (adhesion of recording paper dust) is eliminated at the time t4, and ΔT is decreased after the time t4. As a result, ΔT is below PT at the time t5.

The case where T1 and T2 are changed to T1(*b*) and T2(*b*), respectively, will be described. In this case, for example, recording paper dust or the like is deposited on the lens 38, thereby causing contamination. ΔT<PT from the time t1 to the time t3, and ΔT≧PT after the time t3. The first print temperature control, in which the infrared temperature sensor 30 is utilized, is executed from the time t1 to the time t3. After the time t3, the second print temperature control, in which the thermistor 40 is utilized, is executed.

(Case where Abnormality is Caused in Infrared Temperature Sensor from Start of Print Temperature Control)

Figure 20:
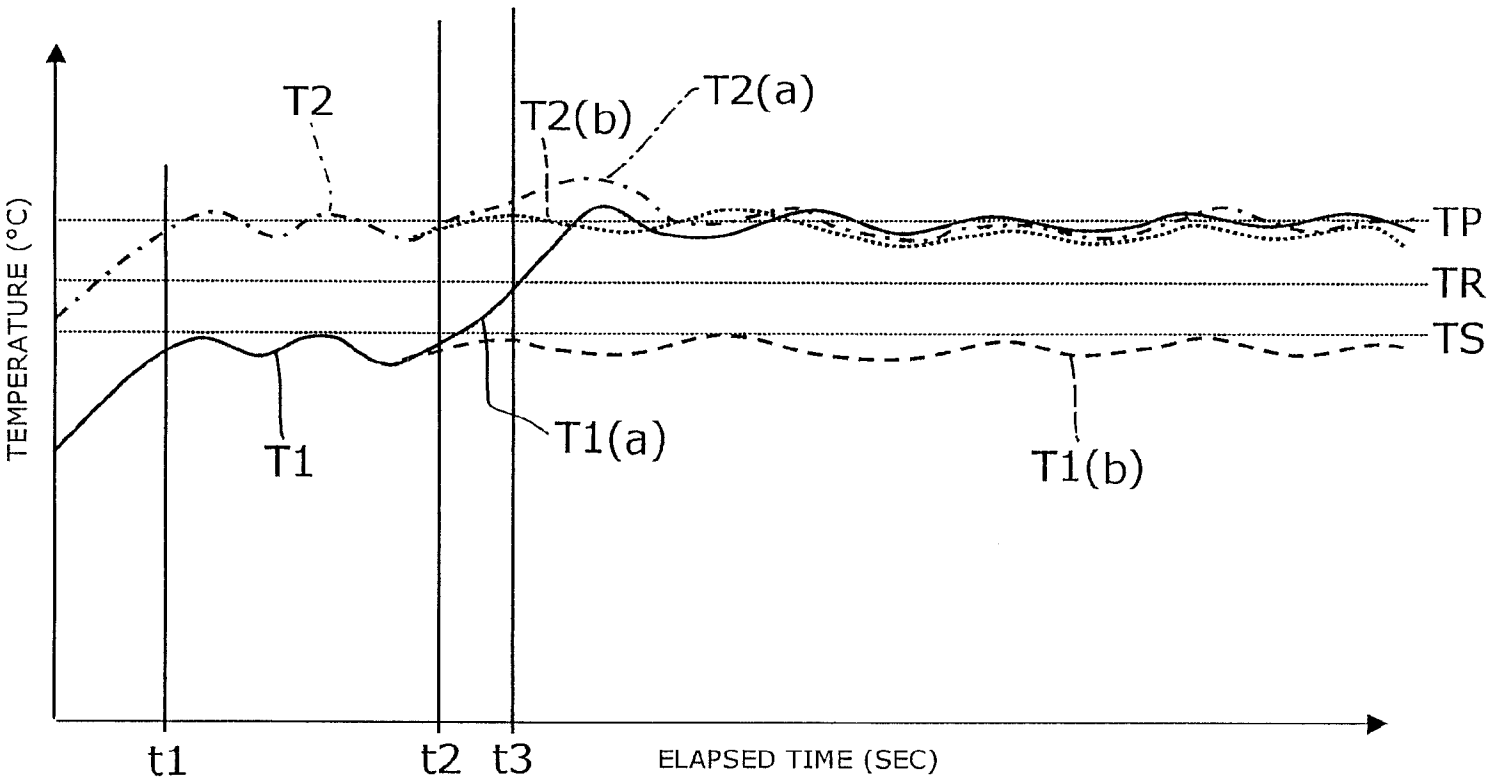
FIG. 20 is a graph illustrating changes in detected temperature when an abnormality has been caused in the infrared temperature sensor since start of print temperature control.

Referring to FIG. 20, a case where an abnormality is caused in the infrared temperature sensor 30 from the start of the print temperature control will be described. The second start-up temperature control is executed until a time t1, and the print temperature control is executed after the time t1.

FIG. 20 illustrates two types of temperature changes in the first temperature T1 obtained by the infrared temperature sensor 30. A graph of the first temperature T1 is branched into a graph of a first temperature T1(*a*) and a graph of a first temperature T1(*b*) at a time t2. The graph of the first temperature T1(*a*) illustrates a case where the abnormality in the infrared temperature sensor 30 has been eliminated at some point. The graph of the first temperature T1(*b*) illustrates a case where the abnormality in the infrared temperature sensor 30 has not been eliminated. Furthermore, the second temperature T2 is also branched into a graph of T2(*a*) and a graph of T2(*b*) in accordance with the branching of the first temperature T1.

The case where T1 and T2 are changed to T1(*a*) and T2(*a*), respectively, will be described. $\Delta T \geqq PT$ from the time t1 to a time t3, and $\Delta T < PT$ after the time t3. The second print temperature control is executed from the time t1 to the time t3. After the time t3, the first print temperature control is executed.

The case where T1 and T2 are changed to T1(*a*) and T2(*a*), respectively, illustrates the following situation, for example. The contamination of the lens 38 (adhesion of recording paper dust) is eliminated at the time t2, and $\Delta T$ is decreased after the time t2. As a result, $\Delta T$ is below PT at the time t3.

The case where T1 and T2 are changed to T1(*b*) and T2(*b*), respectively, will be described. Also after the time t2, $\Delta T$ PT. Therefore, also after the time t2, the second print temperature control, in which the thermistor 40 is utilized, is executed.

Figure 21:
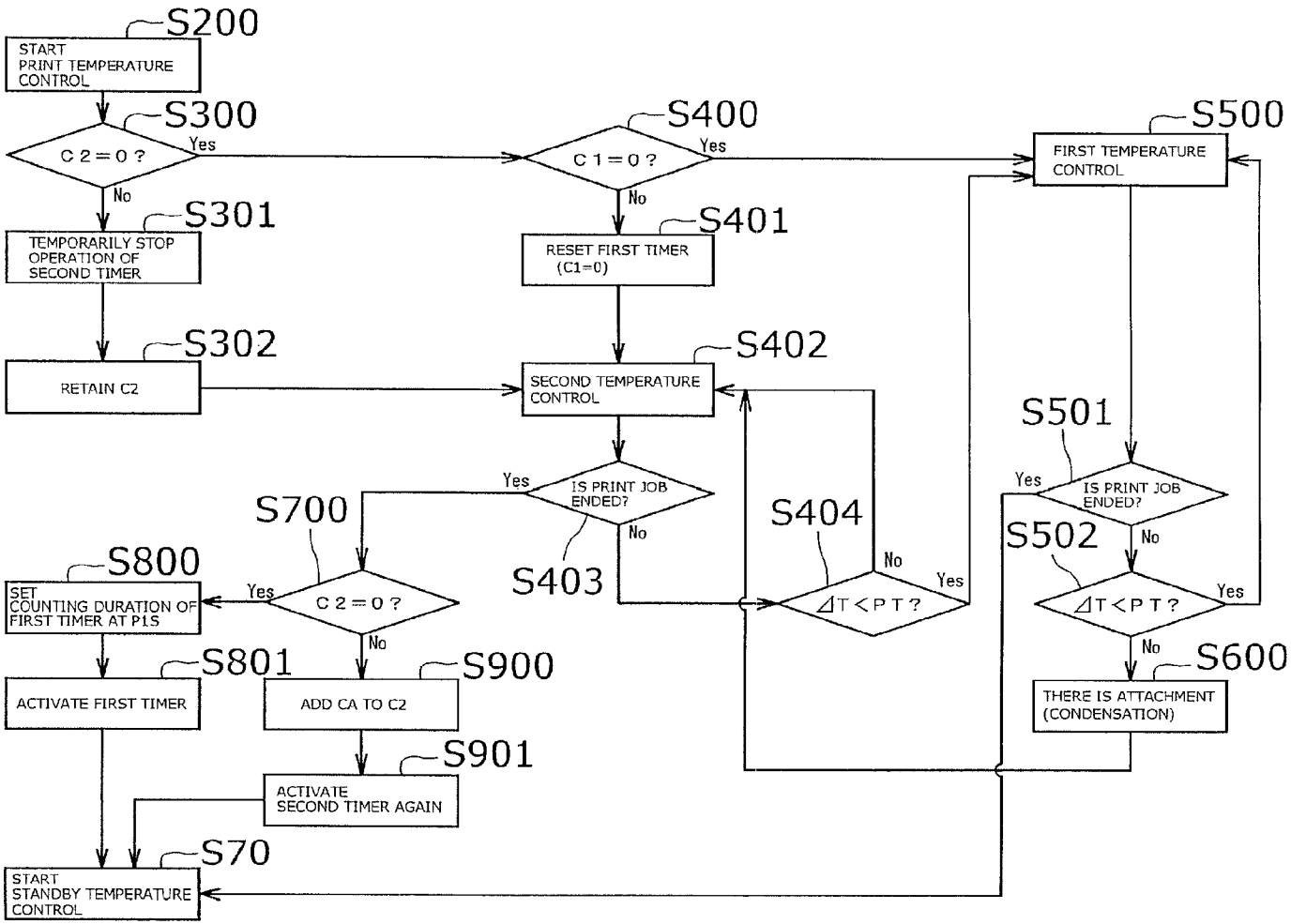
FIG. 21 is a flow chart of print temperature control.

Referring to FIG. 21, a flow of processing in the print temperature control will be described.

Upon start of the print temperature control (Step S200), the system controller 90 acquires information on the state of the infrared temperature sensor 30. In other words, the system controller 90 confirms whether or not the second elapsed time C2 is 0 (Step S300), and confirms whether or not the following equation holds: First Elapsed Time C1=0 (Step S400).

Determination results in Steps S300 and S400 each indicate the state of the infrared temperature sensor 30 at the end of the previous temperature control (start-up temperature control). In the case of the "normal state" (C1=C2=0), the processing proceeds to a loop including Step S500 to Step S502. The loop including Step S500 to Step S502 is associated with the first temperature control. In the case of the "suspected condensation state" (C1≠0 & C2=0), the processing proceeds to a loop including Step S402 to Step S404 via Step S401. The loop including Step S402 to Step S404 is associated with the second temperature control. In Step S401, the system controller 90 resets the counting of the first timer 91. In the case of the "suspected contamination state" (C1=0 & C2≠0), the processing proceeds to a loop including Step S402 to Step S404 via Steps S301 and S302. The system controller 90 stops the counting of the second timer 92 in Step S301, and retains the second elapsed time in Step S302.

The case where the processing has proceeded to the loop including Step S500 to Step S502 will be described. In the loop including Step S500 to Step S502, the first temperature control, in which the infrared temperature sensor 30 is utilized, is executed. In Step S500, electric power is supplied to the heater 80 by the heater control part 60 so that the first temperature T1 is maintained at the print temperature TP. Further, during the execution of Step S500, Yes/No determinations of Step S501 and Step S502 are made for each given period of time. When the answer is Yes in Step S501 or the answer is No in Step S502, the loop including Step S500 to Step S502 ends. When the answer is No in Step S501 and the answer is Yes in Step S502, Step S500 is executed again. Then, the loop including Step S500 to Step S502 is continued.

In Step S501, it is determined whether or not a print job has occurred. When the answer is Yes in Step S501, the print temperature control is ended, and the standby temperature control (FIG. 17) is newly started (Step S70).

In Step S502, it is determined whether or not the detected temperature difference $\Delta T$ falls within the predetermined temperature difference PT. When the answer is No in Step S502, the processing proceeds to Step S600.

When the processing has proceeded to Step S600, it is determined by the system controller 90 that condensation has occurred as attachment on the lens 38. As mentioned above, condensation might occur on the lens 38 by evaporation of moisture contained in the recording paper. Subsequently, the processing proceeds to the loop including Step S402 to Step S404.

The case where the processing has proceeded to the loop including Step S402 to Step S404 will be described. In the loop including Step S402 to Step S404, the second temperature control, in which the thermistor 40 is utilized, is executed. In Step S402, electric power is supplied to the heater 80 by the heater control part 60 so that the second temperature T2 becomes the print temperature TP. Furthermore, during the execution of Step S402, Yes/No determinations of Step S403 and Step S404 are made for each given period of time. When the answer is Yes in Step S403 or the answer is Yes in Step S404, the loop including Step S402 to Step S404 ends. When the answer is No in Step S403 and the answer is No in Step S404, Step S402 is executed again. Then, the loop including Step S402 to Step S404 is continued.

In Step S403, it is determined whether or not a print job has occurred. When the answer is Yes in Step S403, the processing proceeds to Step S700.

In Step S404, it is determined whether or not the detected temperature difference $\Delta T$ falls within the predetermined temperature difference PT. When the answer is Yes in Step S404, the processing proceeds to the loop including Step S500 to Step S502. Thus, upon returning of the detected temperature difference $\Delta T$ within the predetermined temperature difference PT, the second temperature control is switched to the first temperature control.

In Step S700, it is determined whether or not the second elapsed time C2 is 0. In this case, when C2≠0, it means that the processing has proceeded from Steps S300 and S400 to Step S301. When C2=0, it means that the processing has proceeded from Steps S300 and S400 to Step S401. In other words, when the answer is Yes in Step S700, the state of the infrared temperature sensor 30 at the end of the previous temperature control is the "suspected condensation state". When the answer is No in Step S700, the state of the infrared temperature sensor 30 at the end of the previous temperature control is the "suspected contamination state".

When the answer is Yes in Step S700, the processing proceeds to Step S800. In Step S800, the counting duration of the first timer 91 is set at the first short predetermined time P15 (30 secs). In Step S801 subsequent to Step S800, the counting of the first timer 91 is started. Then, the print temperature control is ended, and the standby temperature control (FIG. 17) is newly started (Step S70).

When the answer is No in Step S700, the processing proceeds to Step S900. In Step S900, a predetermined additional time CA is added to the second elapsed time C2 retained in Step S302.

In the present embodiment, the additional time CA is 30 secs.

In Step S901 subsequent to Step S900, the counting of the second timer 92 is started again. Then, the print temperature control is ended, and the standby temperature control (FIG. 17) is newly started (Step S70).

EFFECTS OF PRESENT EMBODIMENT

The image forming device 1 of the present embodiment achieves the following effects.

In the image forming device 1, when the detected temperature difference ΔT is less than the predetermined temperature difference PT, the temperature control for the heater (heater 80) is executed by utilizing the first temperature detector. Therefore, an appropriate print quality is obtained. Further, when the detected temperature difference ΔT is equal to or greater than the predetermined temperature difference PT, the second temperature control is executed using the second temperature detector. Therefore, occurrence of a temperature control abnormality resulting from erroneous detection of the first temperature detector is prevented. Furthermore, when the elapsed time during which the detected temperature difference ΔT is equal to or greater than the predetermined temperature difference PT has exceeded the predetermined time, the warning device (alarm 29) is activated.

Therefore, the temperature controller (system controller 90) makes a comparison between the length of the elapsed time and that of the predetermined time, thereby making it possible to determine whether or not a warning to a user is necessary. In other words, the temperature controller is capable of separately recognizing occurrence of condensation that induces temporary erroneous detection, and occurrence of contamination that induces permanent erroneous detection.

In the image forming device 1, in a situation where occurrence of condensation is suspected, the predetermined time is a time that is the sum of the first predetermined time (first long predetermined time P1L or second short predetermined time P1S) and the second predetermined time P2, and in a situation where occurrence of contamination is suspected, the predetermined time is a time of only the second predetermined time P2.

Hence, in the situation where occurrence of condensation is suspected, the temperature controller sets the predetermined time to be longer than that of the situation where occurrence of contamination is suspected, and therefore, the temperature controller is capable of accurately making a distinction between condensation that is eliminated by continuation of heating, and contamination that is not eliminated by continuation of heating.

In the image forming device 1, for the situation where occurrence of condensation is suspected, a distinction is made between occurrence of condensation at the time of activation and occurrence of condensation in a print job.

Hence, in the case of occurrence of condensation at the time of activation, the temperature controller sets the first predetermined time to be longer than that of the case of occurrence of condensation in a print job, and therefore, the temperature controller does not waste time for elimination of condensation.

In the image forming device 1, the operation of the heater is stopped in the case of occurrence of contamination, thus making it possible to reliably prevent occurrence of a temperature control abnormality.

In the image forming device 1, the operation of the heater is not stopped during occurrence of a print job, thus preventing a reduction in print efficiency.

In the image forming device 1, both of the first temperature detector and the second temperature detector measure a temperature of a portion of the heated body (heating roller 21), which is located within the region of the minimum passage width W. In this position, heat is lost from the heater by the recording paper P, and therefore, the temperature distribution in the longitudinal direction of the heater is unbalanced by a change in the width of the recording paper P. However, the temperature of the heater within the region of the minimum passage width W is constant.

Consequently, the first temperature detector and the second temperature detector are capable of always determining the region having the same temperature as a detection target. Accordingly, an accurate difference between the temperature detected by the first temperature detector and the temperature detected by the second temperature detector is obtainable. Furthermore, since the light receiving body and the heat receiving body are located at different positions in the longitudinal direction of the heater, flexibility of layout is ensured.

REFERENCE SIGNS LIST

1 image forming device
20 fuser
21 heating roller (heated body)
29 alarm (warning device)
30 infrared temperature sensor
38 lens (light receiving body)
40 thermistor (heat receiving body)
60 heater control part
70 A/D conversion PART (part of first and second temperature detectors)
80 heater
90 temperature controller (part of first and second temperature detectors)
91 first timer
92 second timer
P1L first long predetermined time
P1S first short predetermined time
P2 second predetermined time
W minimum passage width

The invention claimed is:

1. An image forming device for forming a toner image on a recording paper based on a print job including image information, the image forming device comprising:

a heated body for fusing toner to the recording paper by heat;

a heater for heating the heated body;

a light receiving body located so as not to be in contact with the heated body;

a first temperature detector for detecting, based on an amount of infrared rays incident upon the light receiving body from the heated body, a first temperature equivalent to a surface temperature of the heated body;

a heat receiving body located so as not to be in contact with the heated body;

a second temperature detector for detecting, based on a temperature of the heat receiving body heated by the heated body, a second temperature equivalent to the surface temperature of the heated body;

a temperature controller for selectively executing either first temperature control for controlling an output of the heater so that the first temperature follows a predetermined target temperature, or second temperature control for controlling the output of the heater so that the second temperature follows the target temperature;

a timer for measuring an elapsed time during which the second temperature control is continuously executed; and a warning device for proving notification of an abnormality in the first temperature detector, wherein the temperature controller performs the first temperature control when a detected temperature difference between the first temperature and the second temperature is less than a predetermined temperature difference, performs the second temperature control when the detected temperature difference is equal to or greater than the predetermined temperature difference, and activates the warning device when the elapsed time has become equal to or greater than a predetermined time.

2. The image forming device according to claim 1, wherein the predetermined time is a time that is the sum of a first predetermined time and a second predetermined time when the second temperature control is started in a state in which the predetermined target temperature has never been reached by the first temperature control, and/or when the second temperature control is started after occurrence of a print job, and wherein the predetermined time is a time of only the second predetermined time when the second temperature control is started in a state in which the predetermined target temperature has been reached by the first temperature control and then no print job occurs.

3. The image forming device according to claim 2, wherein the first predetermined time is a first long predetermined time, or a first short predetermined time shorter than the first long predetermined time, wherein the first long predetermined time is used as the first predetermined time when the second temperature control is started in a state in which the predetermined target temperature has never been reached by the first temperature control, and wherein the first short predetermined time is used as the first predetermined time when the second temperature control is started after occurrence of a print job.

4. The image forming device according to claim 1, wherein the temperature controller stops an operation of the heater when the elapsed time has become equal to or greater than the predetermined time.

5. The image forming device according to claim 4, wherein the temperature controller does not stop the operation of the heater during occurrence of a print job.

6. The image forming device according to claim 1, wherein the light receiving body and the heat receiving body are located within a minimum passage width region of the recording paper.

7. A fuser comprising a heated body for fusing toner to a recording paper by heat, the fuser comprising:

a heater for heating the heated body;

a light receiving body located so as not to be in contact with the heated body;

a first temperature detector for detecting, based on an amount of infrared rays incident upon the light receiving body from the heated body, a first temperature equivalent to a surface temperature of the heated body;

a heat receiving body located so as not to be in contact with the heated body;

a second temperature detector for detecting, based on a temperature of the heat receiving body heated by the heated body, a second temperature equivalent to the surface temperature of the heated body;

a temperature controller for selectively executing either first temperature control for controlling an output of the heater so that the first temperature follows a predetermined target temperature, or second temperature control for controlling the output of the heater so that the second temperature follows the target temperature;

a timer for measuring an elapsed time during which the second temperature control is continuously executed; and a warning device for proving notification of an abnormality in the first temperature detector, wherein the temperature controller performs the first temperature control when a detected temperature difference between the first temperature and the second temperature is less than a predetermined temperature difference, performs the second temperature control when the detected temperature difference is equal to or greater than the predetermined temperature difference, and activates the warning device when the elapsed time has become equal to or greater than a predetermined time.

* * * * *